US007199646B1

(12) United States Patent
Zupcau et al.

(10) Patent No.: US 7,199,646 B1
(45) Date of Patent: Apr. 3, 2007

(54) HIGH PSRR, HIGH ACCURACY, LOW POWER SUPPLY BANDGAP CIRCUIT

(75) Inventors: Dan Laurentiu Zupcau, Starkville, MS (US); Steven Meyers, Round Rock, TX (US)

(73) Assignee: Cypress Semiconductor Corp., San Jose, CA (US)

( * ) Notice: Subject to any disclaimer, the term of this patent is extended or adjusted under 35 U.S.C. 154(b) by 112 days.

(21) Appl. No.: 10/940,184

(22) Filed: Sep. 14, 2004

Related U.S. Application Data

(60) Provisional application No. 60/505,117, filed on Sep. 23, 2003.

(51) Int. Cl.
*G05F 3/24* (2006.01)
*G05F 3/26* (2006.01)

(52) U.S. Cl. ..... 327/539; 323/314; 323/315

(58) Field of Classification Search ..... 327/539–543; 323/312–316

See application file for complete search history.

(56) References Cited

U.S. PATENT DOCUMENTS 5,900,773 A * 5/1999 Susak ..... 327/539
6,160,391 A 12/2000 Banba ..... 323/313
6,323,630 B1 11/2001 Banba ..... 323/313
6,531,857 B2 * 3/2003 Ju ..... 323/316
6,677,808 B1 * 1/2004 Sean et al. ..... 327/539
6,897,714 B2 * 5/2005 Mori ..... 327/541
6,906,581 B2 * 6/2005 Kang et al. ..... 327/539

* cited by examiner

*Primary Examiner*—Timothy P. Callahan
*Assistant Examiner*—Terry L. Englund
(74) *Attorney, Agent, or Firm*—Kevin L. Daffer; Daffer McDaniel, LLP

(57) ABSTRACT

A bandgap circuit comprising a current generation circuit and a current replication circuit is provided herein. The output current of the current generation circuit is generated as a weighted sum of two currents. The circuit configuration of the current generation circuit allows it to function at low power supply voltages, e.g., on the order of 1 V. The current replication circuit includes an operational amplifier, which when configured in conjunction with MOS cascode current sources and the current generation circuit, significantly increases the accuracy and insensitivity to power supply noise of the bandgap circuit output current. A resistor may be included between the bandgap circuit output node and ground for generating a reference voltage with increased accuracy and insensitivity to power supply noise.

29 Claims, 14 Drawing Sheets

HIGH PSRR, HIGH ACCURACY, LOW POWER SUPPLY BANDGAP CIRCUIT

PRIORITY CLAIM

This application claims benefit of priority to the Provisional Patent Application Ser. No. 60/505,117, entitled "High PSRR, High Accuracy, Low Power Supply Bandgap Circuit," filed Sep. 23, 2003, which is hereby incorporated in its entirety.

BACKGROUND OF THE INVENTION

1. Field of the Invention

This invention relates to circuits used to generate reference currents and reference voltages on a semiconductor device and, more particularly, to low power supply voltage circuits capable of generating reference currents and reference voltages on a semiconductor device with high accuracy and reduced sensitivity to power supply noise.

2. Description of the Related Art

The following descriptions and examples are not admitted to be prior art by virtue of their inclusion within this section.

Bandgap reference circuits are known for generating reference voltages, which exhibit little variation across defined ranges of temperatures, process corners and power supply voltages. FIG. 1 shows an exemplary block diagram for a Bandgap reference circuit. Circuit 100 in FIG. 1 generates a reference voltage $V_{REF}$ as a weighted sum of two voltages: $V_1$, having a positive temperature coefficient ($TC_{POSV}$), and $V_2$, having a negative temperature coefficient ($TC_{NEGV}$). The reference voltage may, therefore, be expressed as:

$$V_{REF}=\alpha 1*V_1=\alpha 2*V_2 \tag{1}$$

where $$TC_{POSV}=d(V_1)/dT>0, \text{ and} \tag{2}$$

$$TC_{NEGV}=d(V_2)/dT<0. \tag{3}$$

In equations (2) and (3) above, $V_1$ is proportional to absolute temperature (PTAT), $V_2$ is linearly decreasing with absolute temperature (CTAT, complementary with absolute temperature) and $\alpha 1$, $\alpha 2$ are non-dimensional coefficients.

As shown in the graph of FIG. 2, Bandgap circuit 100 may be used to provide a relatively constant reference voltage $V_{REF}$ across a defined range of temperatures if the coefficients $\alpha 1$, $\alpha 2$ are chosen such that there is a temperature $T_0$ for which:

$$d(V_{REF})/dT=\alpha 1*TC_{POSV}+\alpha 2*TC^{NEGV}=0 \text{ at } T=T_0 \tag{4}$$

where T is the absolute temperature (K) and $T_{-x}<T_0<T_{+x}$. $T_{-x}$, $T_{+x}$ define the range of temperatures for which voltage generation circuit 100 is specified to work. Bandgap reference circuit 100 may alternately be referred to as a "Voltage output Bandgap circuit".

Alternately, a nominally constant reference voltage $V_{REF}$ across a specified range of temperatures may be generated by creating a reference current and then passing it through a resistor. In one example, circuit 300 (FIG. 3*a*) is used to generate a reference current $I_{OUT}$ as a weighted sum of two currents: $I_1$, having a positive temperature coefficient ($TC_{POS1}$), and $I_2$, having a negative temperature coefficient ($TC_{NEGI}$). In other words, $I_1$ is PTAT and $I_2$ is CTAT. The reference current value may, therefore, be expressed as:

$$I_{OUT}=\beta_1*I_1+\beta_2*I_2 \tag{5}$$

where $\beta_1$ and $\beta_2$ are non-dimensional coefficient values chosen to minimize temperature-dependent variations in the reference current across the range of temperatures considered.

The reference voltage $V_{REF}$ may be generated by passing the reference current $I_{OUT}$ generated by circuit 300 through a resistor of value R such that:

$$V_{REF}=R*I_{OUT} \tag{6}$$

In this manner, the generated reference voltage $V_{REF}$ demonstrates a relatively small variation (i.e., a small $\Delta V_{REF}$, as shown in FIG. 2) over the range of temperatures considered, if temperature-dependent variations in $I_{OUT}$ are minimized. It is to be noted that the temperature coefficient of the resistor R also plays an important role in defining the variation of $V_{REF}$ with temperature. Additional sources of error associated with circuit 300 will be discussed in more detail below. The small variation of $V_{REF}$ with temperature is implemented by selecting appropriate values for the coefficients β1 and β2 in equation (5) such that the generated reference voltage $V_{REF}$ has the property:

$$d(V_{REF})/dT=0 \text{ at } T=T_0 \tag{7}$$

where T is the absolute temperature (K) and $T_{-x}<T_0<T_{+x}$. $T_{-x}$, $T_{+x}$ define the range of temperatures for which current generation circuit 300 is specified to work. Circuit 300 may alternately be referred to as a "Current output Bandgap circuit".

In some cases, the negative temperature coefficient current, $I_2$ (CTAT), can be generated in circuit 300 by developing a forward voltage ($V_{D1}$) of a p-n junction diode across a resistor (R1), such that:

$$I_2=V_{D1}/R \tag{8}$$

Alternately, $I_2$ can be generated by developing a base-emitter voltage ($V_{BE}$) of a bipolar junction transistor (BJT) across a resistor (R1) when the BJT is biased in normal active mode. As used herein, a "normal active mode of operation" for a BJT refers to the case when the base-emitter junction of the BJT is forward biased and the base collector junction of the BJT is reverse biased.

In Current output Bandgap circuit 300, the positive temperature coefficient current $I_1$ (PTAT), can be generated by developing a voltage across another resistor, R2. For example, the voltage across resistor R2 can be generated as 1) the difference between the forward voltages of two p-n junction diodes operating at different current densities, or 2) the difference between the base-emitter voltages of two bipolar junction transistors (BJT) biased in normal active mode of operation, with the two respective base-emitter junctions having different current densities. If the implementation with the two p-n junction diodes is chosen to generate the voltage across resistor R2, the positive temperature coefficient current $I_1$ is expressed as:

$$I_1=[V_{D1}-V_{D2}]/R2 \tag{9}$$

where $V_{D1}$ and $V_{D2}$ represent the forward voltages of the two diodes, respectively. If the ratio between the current densities through the two forward biased p-n junction diodes is N, equation (9) becomes:

$$\begin{aligned} I_1 &= [V_t*\ln\{I_A/IS1\}-V_t*\ln\{I_B/IS2\}]/R2 \\ &= (k*T/q)*[\ln\{(I_A/I_B)*(A2/A1)\}]/R2 \end{aligned} \tag{10}$$

where $I_A$ and $I_B$ are the respective currents through the forward biased p-n junction diodes, A1 and A2 are the respective areas of the p-n junction diodes, and IS1, IS2 are the saturation currents for the respective diodes, which are proportional to their areas (IS1 is proportional to A1, IS2 is proportional to A2). In addition, Vt is the thermal voltage (k*T/q), where $k=1.38*10^{-23}$ J/K and $q=1.6*10^{-19}$ C and T is the absolute temperature in degrees Kelvin. If $I_A=I_B$ (the current values running through the two forward biased p-n diodes are equal) and the ratio between the areas of the two p-n junction diodes is N (i.e., the ratio between A2 and A1 is N), then equation (9) becomes:

$$I_1=(k*T/q)*[ln(N)]/R2 \quad (11)$$

The ratio N between the areas of diodes D1, D2 is usually implemented by replicating the first p-n junction diode D1 a number of times (N) to generate the second diode D2 with N times larger area.

FIG. 3*b* shows in more detail the sources of error that may be associated with Current output Bandgap circuit 300, the type of Bandgap reference typically used at low power supply voltages. As shown in FIG. 3*b*, circuit 300 comprises a current generation circuit (310) and a current replication circuit (320). Circuit 310 generates the current $I_{OUT_INT}$ according to equation (5) as a weighted sum of a PTAT current and a CTAT current.

In some cases, the output of circuit 310 may be affected by errors due to power supply variation ($\epsilon_{vcc}$), temperature variation ($\epsilon_{temp}$), and/or process variation ($\epsilon_{process}$). Low power supply values preclude the use of cascoded devices in the current generation circuit due to voltage headroom limitations, thus increasing the power supply noise sensitivity of circuit 310 (and consequently, circuit 300). For example, a system application for a Current output Bandgap circuit (300) may require that the variation of $I_{OUT}$ relative to its average value (defined as $\Delta(I_{OUT})/I_{OUT}$ when the power supply varies by 10%) be −60 dB for the range of power supply noise frequencies between DC and 100 kHz. However, this specification may be difficult to achieve at low power supply voltage values due to voltage headroom limitations.

Current replication circuit 320 generates the output current $I_{OUT}$ as an identical copy (k=1) or a linearly scaled version (k different than 1) of current $I_{OUT_INT}$. Similar to circuit 310, the output of circuit 320 may also be affected by errors due to power supply, temperature and/or process variations, as well as current replication errors. The errors due to the current replication function are labeled in FIG. 3*b* as $\epsilon_{replica}=\epsilon_{replica}$(vcc, process, temperature). Due to the strict requirements for Bandgap reference accuracy in some applications (e.g. 1% accuracy over power supply, temperature and process variations for voltages generated by passing $I_{OUT}$ through resistors), the error introduced by the current replication circuit should be reduced to negligible values.

The current output $I_{OUT}$ of the Current output Bandgap circuit 300 may also be used to generate a reference voltage $V_{REF}$, as stated above, by passing $I_{OUT}$ through a resistor. Thus, the Current output Bandgap may be used to implement a Voltage output Bandgap. However, reduced accuracy in the current replication stage (due, e.g., to replication errors when transferring $I_{OUT_INT}$ to $I_{OUT}$ in circuit 300 of FIG. 3*b*) reduces the accuracy of the reference voltage $V_{REF}$. In the same manner, the relatively high sensitivity of the output current $I_{OUT}$ to power supply noise at low power supply values implies that the reference voltage $V_{REF}$ will also be highly sensitive to the power supply noise.

The problems described above for the Current output Bandgap and Voltage output Bandgap (i.e., low accuracy output current/voltage and high power supply noise sensitivity) become harder to solve as the power supply voltages for CMOS processes scale down toward the 1 V value and below. Consequently, a need exists for Current output Bandgap circuits and Voltage output Bandgap circuits capable of generating high accuracy reference currents and high accuracy reference voltages, respectively, with decreased sensitivity to power supply noise when supplied with relatively low voltage power supplies.

SUMMARY OF THE INVENTION

The problems outlined above may be in large part addressed by an improved Bandgap reference circuit. More specifically, the present invention focuses on a Bandgap reference circuit that can operate at relatively low power supply values (e.g., 1 V power supply voltage range).

The Bandgap reference circuit described herein generally includes a current generation circuit and a current replication circuit. The primary function of the current generation circuit is to generate a reference current as a weighted sum of a PTAT (proportional to absolute temperature) current and a CTAT (complementary to absolute temperature) current. The primary function of the current replication circuit is to transfer a highly accurate copy, identical or linearly scaled, of the reference current generated in the current generator circuit to the output of the Bandgap reference circuit.

In some embodiments, the current generator circuit may include a first voltage controlled current source and a second voltage controlled current source, each coupled between the ground node and the inverting and non-inverting inputs of a first operational amplifier, respectively. The common voltage control pins (i.e., gate terminals) of the first and second voltage controlled current sources are connected to the output of the first operational amplifier. A first resistor is connected in parallel with a first forward biased p-n junction diode coupled between the inverting input of the first operational amplifier and the power supply node. A second resistor is coupled between the non-inverting input of the first operational amplifier and the power supply node. A third resistor is coupled in series with a second forward biased p-n junction diode between the non-inverting input of the first operational amplifier and the power supply node.

The first operational amplifier output controls the currents generated by the first and second voltage controlled current sources in order to establish a negative feedback reaction in conjunction with the first and second voltage controlled current sources, the first, second and third resistors and the first and second p-n junction diodes. The negative feedback reaction in the current generation circuit enables the current values in the first and second voltage controlled current sources to represent weighted sums of a PTAT (proportional to absolute temperature) current and a CTAT (complementary to absolute temperature) current, respectively. The currents generated by the first and second voltage controlled current sources may be adjusted, so that copies of the respective currents may be used to generate nominally constant voltages across specified resistors.

In some embodiments, the first and second voltage controlled current sources may be implemented with single transistor current sources. In a preferred embodiment, the first and second voltage controlled current sources may be implemented with a pair of NMOS transistors, thus allowing the Bandgap reference circuit to function at relatively low power supply values (e.g., 1 V power supply voltage range).

It is noted, however, that the first and second voltage controlled current sources may alternatively be implemented with a pair of PMOS transistors, in other embodiments of the invention.

In some embodiments, a ratio between the output currents of the first and second voltage controlled current sources may be chosen as an integer factor M. This may be achieved, in some cases, by setting the ratio between the resistance values of the first and second resistors to be a factor of 1/M. In doing so, the sensitivity of the Bandgap circuit output current to the first operational amplifier input offset may be substantially decreased.

In some embodiments, the current replication circuit may include a first NMOS cascode current source, a second NMOS cascode current source, a PMOS bias generator circuit and a PMOS cascode current source. The lower transistors of the first and second NMOS cascode current sources may be substantially identical and share the same gate connection. The upper transistors of the first and second NMOS cascode current sources may also be substantially identical and share the same gate connection.

In a preferred embodiment, a second operational amplifier may be included within the current replication circuit for controlling the gate voltages of the upper transistors within the first and second NMOS cascode current sources. The output of the second operational amplifier may be connected to the gates of the upper transistors within the first and second NMOS cascode current sources. In addition, the inverting input of the second operation amplifier may be connected to the drain of a lower transistor within the first NMOS cascode current source, while its non-inverting input is connected to the non-inverting input of the first operational amplifier. The particular configuration of the second operational amplifier, in conjunction with the first and second NMOS cascode current sources, ensures that the reference current from the current generation circuit will be copied with high accuracy to the first and second NMOS cascode current sources.

The PMOS bias generation circuit is connected between the power supply node and the outputs of the first and second NMOS cascode current sources, respectively. The primary function of the PMOS bias generation circuit is to generate bias voltages for the PMOS cascode current source, so that the current in the first and second NMOS cascode current sources may be copied with high accuracy to the PMOS cascode current source in the current replication circuit. The PMOS cascode current source is connected between the power supply node and the output node of the Bandgap circuit. In this manner, the reference current generated in the current generator circuit may ultimately be copied with high accuracy (i.e. identical copy or a linearly scaled version of it) to the output node of the Bandgap reference circuit.

In addition to improving the accuracy with which the reference current from the current generation circuit is copied to the output node of the Bandgap circuit, the second operational amplifier is advantageously configured for increasing the output impedances of the first and second NMOS cascode current sources. This may significantly reduce the portion of the power supply noise that may appear between the gate and source terminals of the upper PMOS transistor in the PMOS cascode current source. In other words, the sensitivity of the Bandgap reference circuit output current to power supply noise may be significantly decreased due to the inclusion of the second operational amplifier in the current replication stage.

The high impedance of the PMOS cascode current source output may also decrease the output node sensitivity to power supply noise. This advantage may be particularly apparent if large digital blocks, which generate significant switching noise, share the same power supply with sensitive analog blocks (e.g. Phase Lock Loops) in the respective silicon chip, requiring a high degree of noise isolation for the bias lines of the analog blocks.

Various objects, features and advantages of the present invention may include, but are not limited to, providing a Bandgap reference circuit that: (i) provides low voltage operation (e.g., 1 V power supply range), (ii) includes a current generation block and a current replication block, (iii) provides increased accuracy due to the use of an operational amplifier in the current replication block and the use of current multiplication in the current generation block, and (iv) provides decreased power supply noise sensitivity due to the use of an operational amplifier in the current replication block and the use of a PMOS cascode current source at the Bandgap reference circuit current output. Additional objects, features and advantages may become evident to one skilled in the art upon reading the detailed description set forth in more detail below.

BRIEF DESCRIPTION OF THE DRAWINGS

Other objects and advantages of the invention will become apparent upon reading the following detailed description and upon reference to the accompanying drawings in which.

Figure 1:
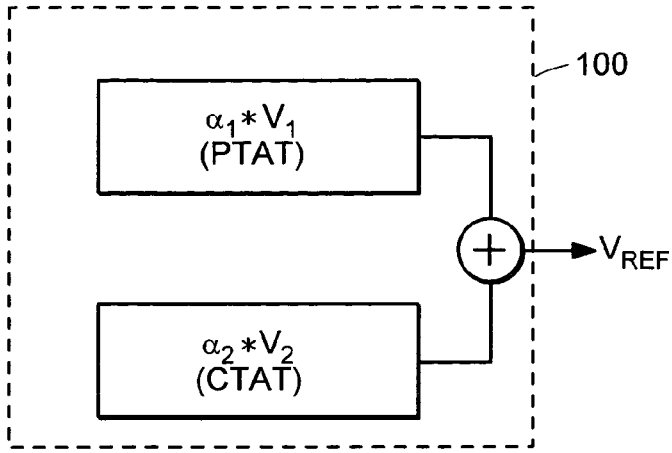
FIG. 1 is a block diagram of a Voltage output Bandgap circuit.
Figure 2:
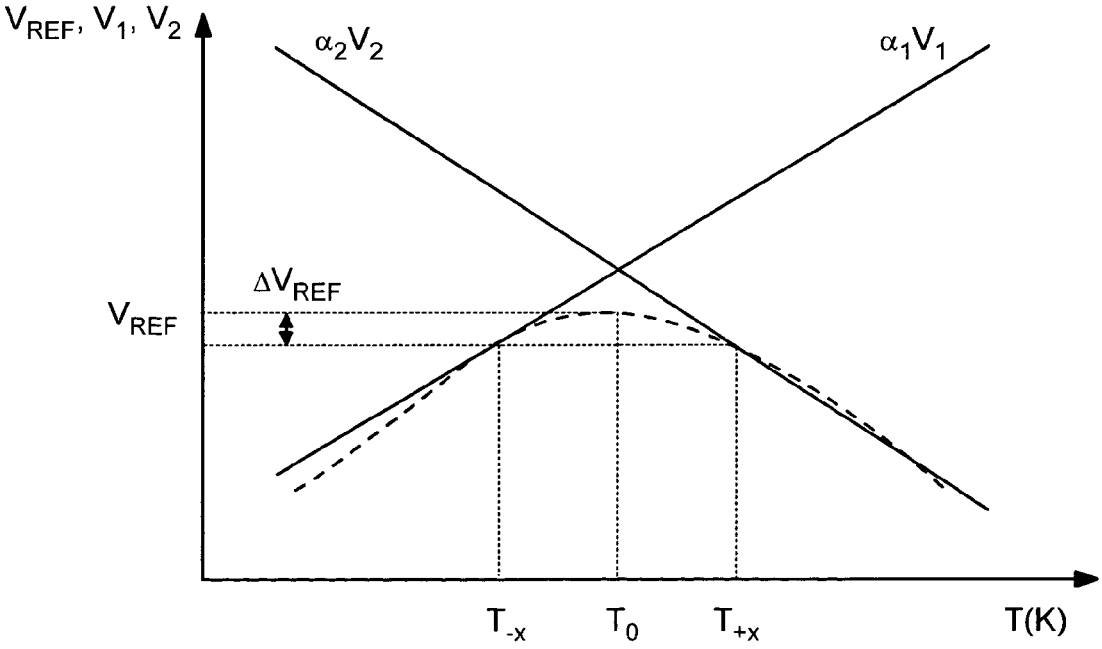
FIG. 2 is a graph illustrating the temperature dependency for the reference voltage ($V_{REF}$) and its voltage components for the Voltage output Bandgap circuit of FIG. 1.
Figure 3A:
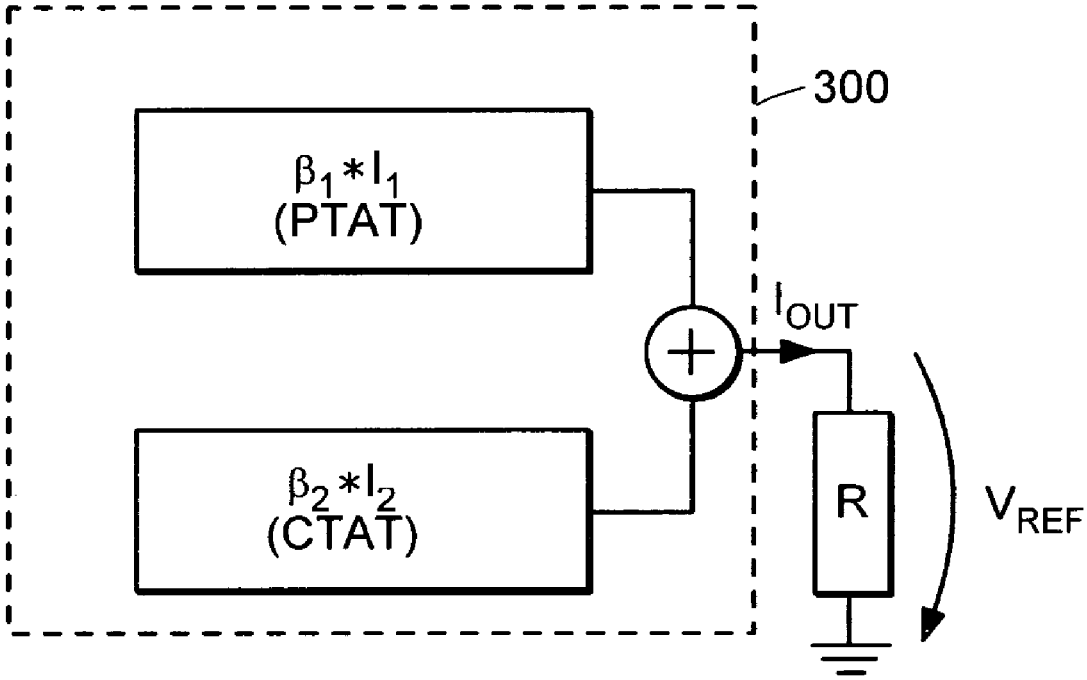
FIG. 3*a* is a block diagram of a Current output Bandgap circuit followed by a current-to-voltage conversion circuit.
Figure 3B:
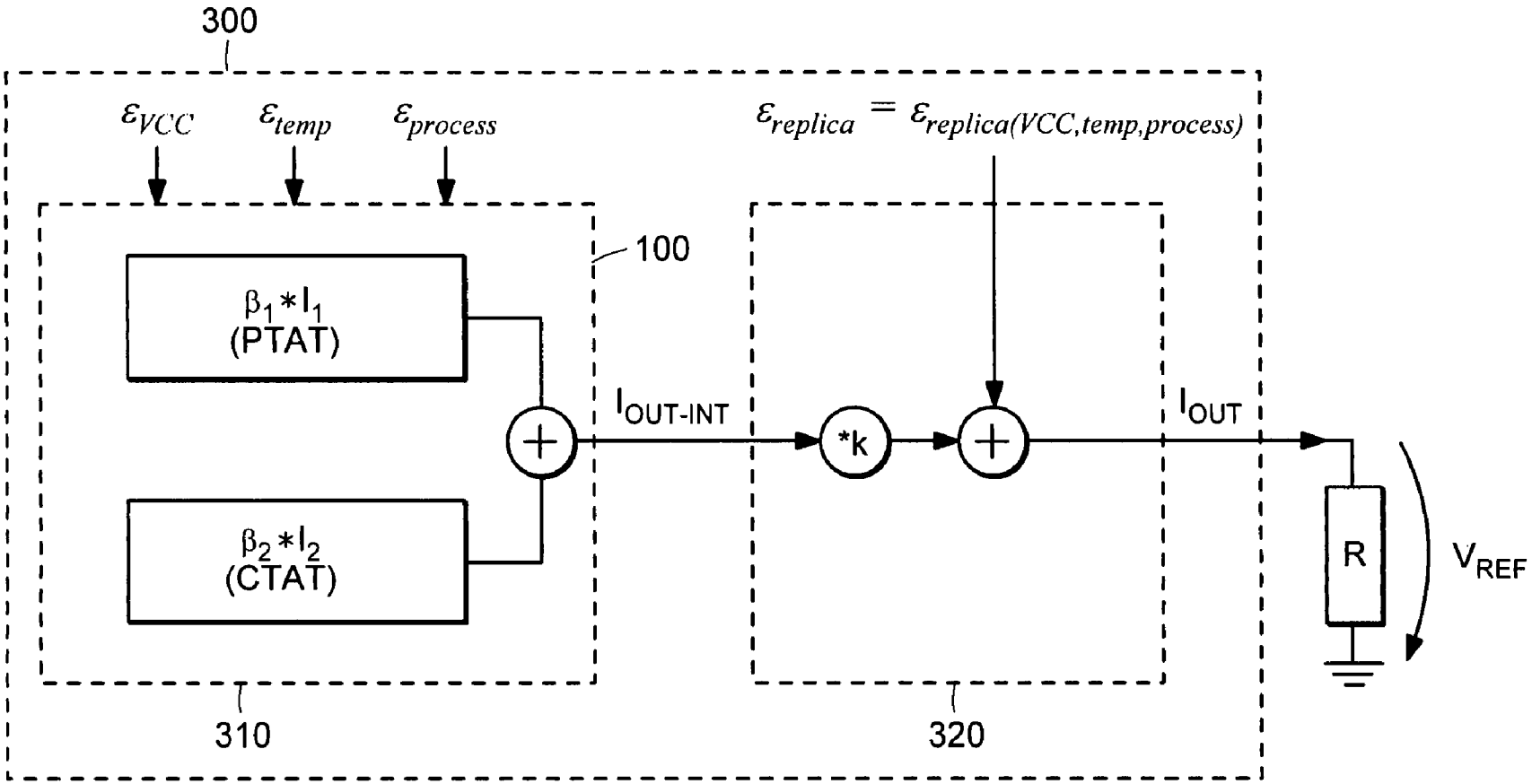
FIG. 3*b* is a block diagram of a Current output Bandgap circuit followed by a current-to-voltage conversion circuit, showing the current generation and current replication circuits and various sources of error commonly associated therewith.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 4:
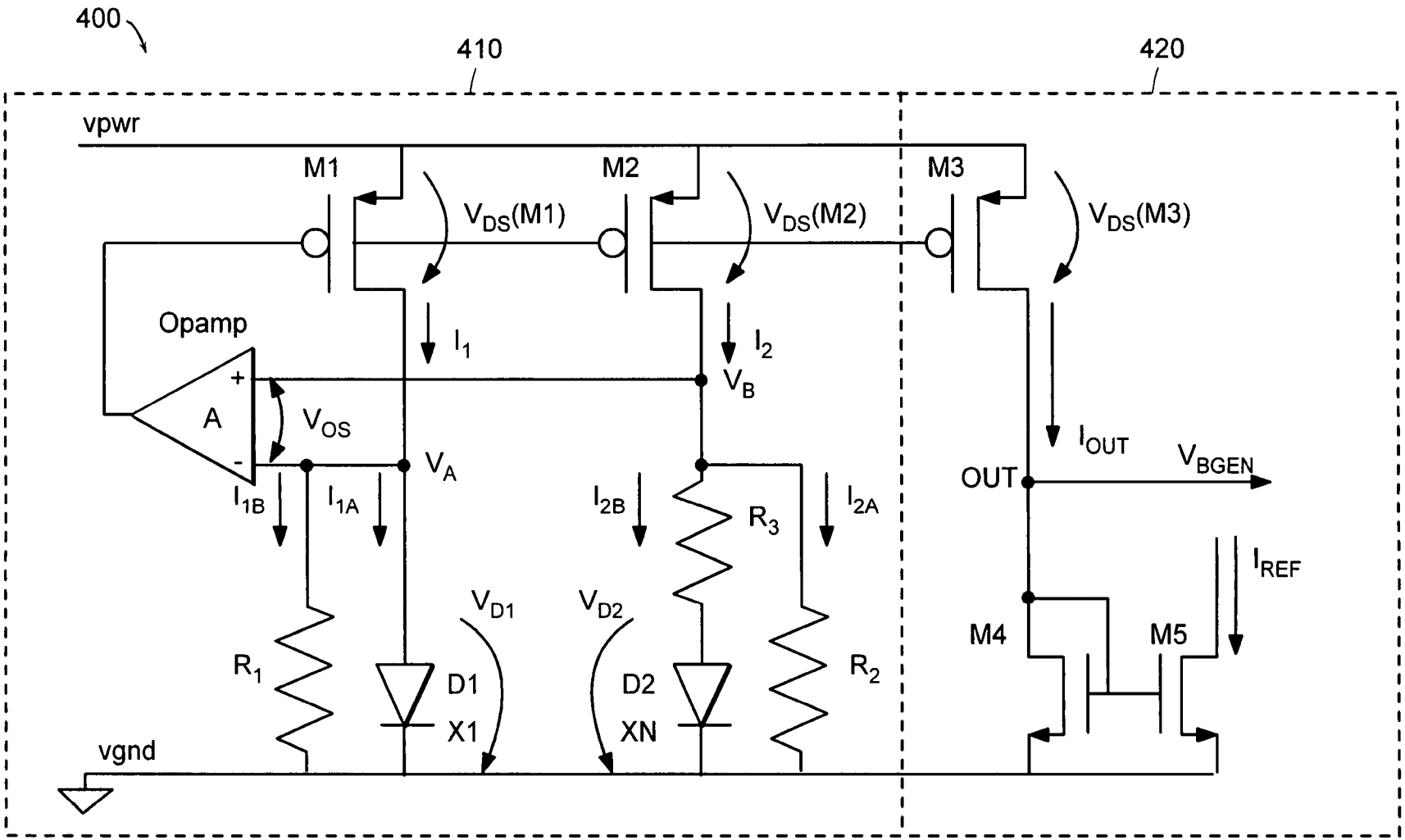
FIG. 4 is a circuit diagram illustrating an exemplary Current output Bandgap circuit.

Turning to the drawings, an exemplary Current output Bandgap circuit 400 is illustrated in FIG. 4 as including a Bandgap Core 410 (referred to below as the "current generation circuit") and a Current Mirroring stage 420 (referred to below as the "current replication circuit"). As shown in FIG. 4, the current generation circuit 410 is a modified diode bridge with two single PMOS voltage controlled current sources (M1 and M2) in two adjacent branches. The source terminals of PMOS current sources M1 and M2 are connected to the power supply node (vpwr) and their gate terminals are connected together. A third branch of the bridge, in series with the drain of PMOS transistor M1, is composed of a resistor (R1) in parallel with a p-n junction diode (D1). The third branch of the bridge is connected between node $V_A$ and ground node (vgnd) in FIG. 4. A fourth branch of the bridge, in series with the drain of PMOS transistor M2 and adjacent to the third branch, is composed of a p-n junction diode D2 (having N times the area of D1) in series with resistor R3 and resistor R2, which appears in parallel with both D2 and R3. The fourth branch of the bridge is connected between node $V_B$ and ground node (vgnd) in FIG. 4.

A high gain operational amplifier (Opamp) is also included within current generation circuit 410. The inputs of the Opamp are connected across one diagonal of the bridge to node $V_A$ (the inverting Opamp input) and node $V_B$ (the non-inverting Opamp input). The output of the Opamp is connected to the gates of PMOS transistors M1, M2, M3 for controlling the currents ($I_1$, $I_2$) through the single PMOS current sources implemented with M1 and M2, as well as the current ($I_{OUT}$) through a single PMOS voltage controlled current source (M3) arranged within current replication circuit 420. The operational amplifier (Opamp) adjusts the currents ($I_1$, $I_2$) through the two single PMOS current sources (M1 and M2) to ensure that the potentials at nodes $V_A$ and $V_B$ are equal, less the error due to its input offset voltage ($V_{OS}$). The power supply voltage is connected across the other diagonal of the bridge, between the power supply node (vpwr) and the ground node (vgnd). A current mirror implemented with NMOS transistors M4 and M5 in circuit 420 copies the output current ($I_{OUT}$) and generates the reference current ($I_{REF}$).

In circuit 400, PMOS transistors M1, M2 and M3 are substantially identical (e.g., they have the same aspect ratio W/L, with W being the width and L being the length of the PMOS devices), the resistance values of R1 and R2 are substantially identical, and the ratio between the current densities through p-n junction diodes D1 and D2 is N (where N is an integer number). Therefore, the negative temperature coefficient current (CTAT) $I_{2A}$ generated through resistor R2 may be expressed as:

$$I_{2A}=[V_{D1}-V_{OS}]/R2 \tag{12}$$

where $V_{D1}$ is the forward voltage across p-n junction diode D1, which has a negative temperature coefficient (e.g. in the range of −1.5 mV/C), and $V_{OS}$ is the input offset voltage of the operational amplifier (Opamp). As noted above, $V_{OS}$ introduces an error term for the CTAT current ($I_{2A}$). On the other hand, the positive temperature coefficient (PTAT) current $I_{2B}$ flowing through resistor R3 may be expressed as:

$$I_{2B}=[V^{D1}-V_{D2}-V_{OS}]/R3=Vt*[ln(N)]/R3-V_{OS}/R3 \tag{13}$$

where $V_{D1}$ is the forward voltage across p-n junction diode D1, $V_{D2}$ is the forward voltage across p-n junction diode D2, N is the ratio between the areas of diodes D2 and D1, respectively, and $V_{OS}$ is the input offset voltage of the operational amplifier (Opamp). As noted above, $V_{OS}$ introduces an error term for the PTAT current ($I_{2B}$). In addition, Vt is the thermal voltage (k*T/q), where T is the absolute temperature (K), $k=1.38*10^{-23}$ J/K, and $q=1.6*10^{-19}$ C.

The current $I_2$ generated by current generation circuit 410 is equal to the sum of currents $I_{2A}$ and $I_{2B}$, which were given in equations (12), (13) above. In addition, the currents $I_1$ and $I_2$ generated by current generation circuit 410 are substantially equal in value due to the fact that PMOS transistors M1, M2 are substantially identical, their drain currents ($I_1$ and $I_2$) are controlled by the same gate-to-source voltage, $V_{GS}$, and they have substantially the same drain-to-source voltage, $V_{DS}$ (neglecting the error due to the Opamp input offset voltage, $V_{OS}$, which would generate a negligible mismatch due to channel length modulation for PMOS transistors M1, M2). The current generated by current generation circuit 410 may be expressed as:

$$I_1=I_2=I_{2A}+I_{2B}=V_{D1}/R2+Vt*[ln(N)]/R3-V_{OS}*(1/R2+1/R3) \tag{14}$$

Therefore, the current ($I_1$, $I_2$) generated by current generation circuit 410 is affected by, and therefore, sensitive to the input offset voltage $V_{OS}$ of the operational amplifier (Opamp) used in current generation circuit 410. To ensure that the input offset ($V_{OS}$) of the operational amplifier (Opamp) does not significantly affect the values of currents $I_1$, $I_2$, the following conditions must be complied with:

$$Vt*[ln(N)]/R3>>V_{OS}*(1/R2+1/R3) \tag{15}$$

$$V_{D1}/R2>>V_{OS}*(1/R2+1/R3) \tag{16}$$

Both equations (15) and (16) above may be used to bound the value of the Opamp input offset, Vos, with (15) being the more restrictive of the two.

Ideally, if PMOS transistors M1, M2, M3 are not affected by the channel length modulation effect, the current ($I_1$, $I_2$) generated by current generation circuit 410 should be replicated without error by the single PMOS current source (M3) in current replication circuit 420 to generate the output current ($I_{OUT}$).

However, the current copying accuracy of the PMOS current source (M3) is affected by the matching between the source-to-drain voltages of PMOS transistors M1, M2 and M3, due to the dependency of the drain current in a MOS device in saturation on the voltage between its source and its drain (i.e., the channel length modulation effect). In other words, the output current ($I_{OUT}$) may be expressed as:

$$I_{OUT}=I_2*(1+\lambda*V_{DS}(M3))/(1+\lambda*V_{DS}(M2)) \quad (17)$$

where λ is the channel length modulation coefficient corresponding to PMOS transistors M2 and M3, and $V_{DS}$(M2) and $V_{DS}$(M3) are the drain-to-source voltages of transistors M2 and M3, respectively.

The currents generated by current generation circuit 410 and current replication circuit 420 may be expressed as:

$$I_2=(\mu_p*Cox/2)*(W/L)*(V_{GS}(M2)-Vth)^2*(1+\lambda*V_{DS}(M2)), \quad (18)$$

$$I_{OUT}=(\mu_p*Cox/2)*(W/L)*(V_{GS}(M3)-Vth)^2*(1+\lambda*V_{DS}(M3)), \quad (19)$$

where Cox is the gate oxide capacitance per unit area ($F/m^2$); $\mu_p$ is the mobility of the holes ($m^2/V*s$); W is the width of the PMOS devices, which is the same for the transistors M1, M2, M3; L is the channel length of the devices, which is the same for transistors M1, M2, M3; $V_{GS}$(M2), $V_{GS}$(M3) are the gate-to-source voltages for transistors M1, M2, M3, which are the same for transistors M1, M2, M3; $V_{DS}$(M2), $V_{DS}$(M3) are the drain-to-source voltages for transistors M1, M2, M3; Vth is the threshold voltage for transistors M1, M2, M3; and λ is the channel length modulation coefficient corresponding to the channel length of transistors M1, M2 and M3.

Equation (17) shows that the current copying accuracy between the current ($I_1$, $I_2$) generated by current generation circuit 410 and the output current ($I_{OUT}$) of Current output Bandgap 400 is adversely affected by the channel length modulation effect, if single MOS transistors are used in current replication circuit 420. In other words, the drain-to-source voltages of PMOS transistors M2 and M3 may not track each other. For example, the drain-to-source voltage of PMOS transistor M3 is equal to the difference between the power supply voltage value and the drain-to-source voltage developed across the diode-connected NMOS transistor M4 in circuit 420. The drain-to-source voltage of PMOS transistor M2 is equal to the difference between the power supply voltage value and the forward bias voltage of p-n junction diode D1 (neglecting the error introduced by the Opamp input offset, $V_{OS}$). Thus, and as shown in equation (17), the use of a single MOS transistor current source in current replication circuit 420 may introduce an amount of error, due to the mismatch between $V_{DS}$(M2) and $V_{DS}$(M3), which reduces the current replication accuracy between the current ($I_1$, $I_2$) generated in current generation circuit 410 and the output current ($I_{OUT}$).

The use of a single transistor current source (PMOS transistor M3 in FIG. 4) to generate the output current ($I_{OUT}$) also degrades the power supply rejection ratio (PSRR) of the Current output Bandgap circuit 400 of FIG. 4. As used herein, the Power Supply Rejection Ratio (PSRR) of a Current output Bandgap circuit may be defined as the change in the output current ($\Delta I_{OUT}$) relative to the average output current ($I_{OUT}$) when the power supply changes by 10% of its value. The Power Supply Rejection Ratio (PSRR) for a Current output Bandgap circuit may be defined at a certain frequency as the change in the output current of a Current output Bandgap ($\Delta I_{OUT}$) relative to the average output current ($I_{OUT}$) when a sinusoidal noise signal with that frequency and 0.05*V(vpwr) of peak-to-peak amplitude is superimposed on the power supply, and where V(vpwr) is the power supply DC value.

Furthermore, the use of a single MOS transistor current source at the output of current replication circuit 420 does not allow the value of the voltage transfer function between the power supply node (vpwr) and the output node (OUT) of Current output Bandgap circuit 400 to decrease below a certain value. The voltage transfer function between the power supply and output nodes (denoted PSG_Vbgen) may be referred to as the "power supply to output node voltage gain."

As used herein, the PSG_Vbgen value for a Current output Bandgap circuit (referring to FIG. 4) may be defined as the value of the transfer function in voltage between the power supply node (vpwr) and the output node (OUT) of the Current output Bandgap circuit. In other words, the PSG_Vbgen value is a measure of the amount of power supply noise voltage fed through to the output node OUT of the Current output Bandgap 400. The value of the PSG_Vbgen parameter at DC may be calculated as:

$$PSG_Vbgen=(1/gm_{M4})/((Rout_{M3}+(1/gm_{M4})), \quad (20)$$

where $gm_{M4}$ is the transconductance of diode-connected NMOS transistor M4, and $Rout_{M3}$ is the output resistance of PMOS current source M3 in circuit 420. From equation (20) it becomes evident that reduced values of PSG_Vbgen would demand high output resistance values from the single PMOS current source M3, for given M4 and DC output current value $I_{OUT}$. On the other hand, single PMOS current source M3 output resistance is limited to a maximum value, thus limiting the minimum achievable value of PSG_Vbgen in equation (20).

For at least these reasons, the Current output Bandgap circuit of FIG. 4 cannot be used to provide bias currents and reference voltages to noise sensitive circuits (e.g., Voltage Controlled Oscillators), which may require, depending on the application, a relatively high Power Supply Rejection Ratio (e.g., PSRR<−60 dB) and a relatively low power supply voltage gain to output node (e.g., PSG_Vbgen <−60 dB) within a frequency range close to DC (e.g., from 0 to 100 kHz), at reduced power supply voltage values.

Figure 5:
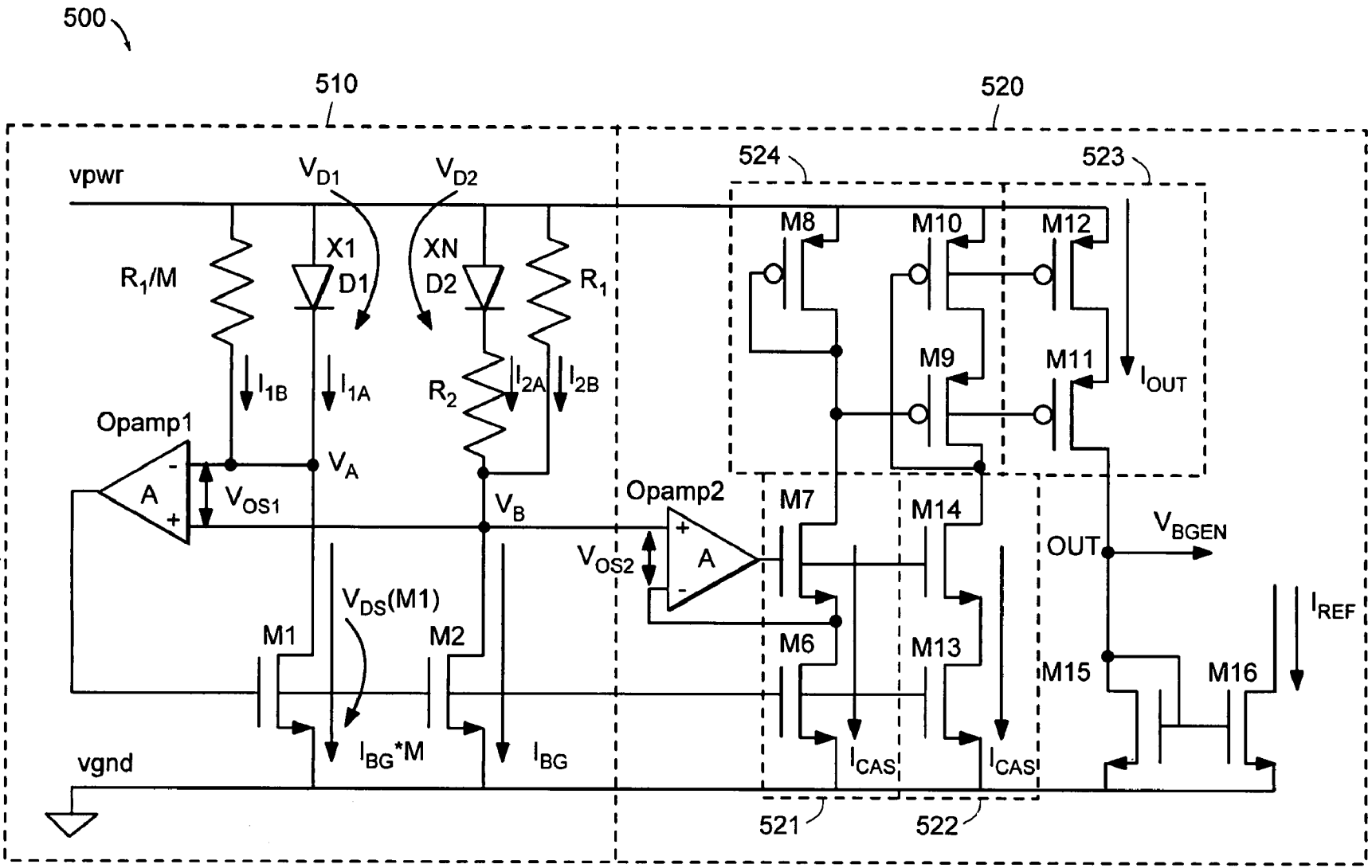
FIG. 5 is a circuit diagram illustrating one embodiment of a Current output Bandgap circuit in accordance with the present invention.

FIG. 5 illustrates one embodiment of a Current output Bandgap circuit (500) in accordance with the present invention. Similar to the previous circuit (400), Current output Bandgap circuit 500 includes a Bandgap Core stage 510 (referred to below as "current generation circuit") and a Current Mirroring stage 520 (referred to below as "current replication circuit").

The current generation circuit 510 is a modified diode bridge with two single NMOS voltage controlled current sources (transistors M1 and M2) in two adjacent branches. The drain of NMOS transistor M1 is connected to node $V_A$, while the source of NMOS transistor M1 is connected to the ground node (vgnd). Likewise, the drain of NMOS transistor M2 is connected to node $V_B$, while the source of NMOS transistor M2 is connected to the ground node (vgnd). The gates of NMOS transistor M1, M2 are connected together. A third branch of the bridge, in series with the drain of NMOS transistor M1, is composed of a resistor of value R1/M (where M is an integer number) in parallel with a p-n junction diode D1. The reason for choosing the value of R1/M for that particular resistor is explained below in relation to equations (22) through (28). The third branch of the bridge is connected between the power supply node (vpwr) and node $V_A$ in FIG. 5.

The current through transistor M1 is chosen to be M times larger than the current through transistor M2 (where M is an integer number chosen to comply with equations (22) through (28)) in order to reduce the influence of the operational amplifier (Opamp1) input offset voltage, $V_{OS1}$, on the current generated by current generation circuit 510, and ultimately, on the value of the Current output Bandgap 500 output current ($I_{OUT}$). A fourth branch of the bridge, in series with the drain of NMOS transistor M2 and adjacent to the third branch, is composed of a p-n junction diode D2 (with N times the area of diode D1, where N is an integer number) in series with resistor R2 and resistor R1, which appears in parallel with both D2 and R2. The fourth branch of the bridge is connected between the power supply node (vpwr) and node $V_B$ in FIG. 5.

Current generation circuit 510 also includes a high gain operational amplifier (Opamp1) having inputs connected across one diagonal of the bridge to node $V_A$ (inverting Opamp1 input) and node $V_B$ (non-inverting Opamp1 input). The output of Opamp1 is coupled for controlling the currents ($I_{BG}$, $I_{BG}$*M) through two single NMOS current sources (M1 and M2). The operational amplifier (Opamp1) adjusts the currents through the two single NMOS current sources (M1 and M2) to ensure that the potentials at nodes $V_A$ and $V_B$ are equal, less the effect of the input offset voltage $V_{OS1}$ of Opamp1. The operational amplifier (Opamp1) controls the current through NMOS transistors M1 and M2 by connecting its output to the gates of transistors M1 and M2. The power supply voltage is connected across the other diagonal of the bridge between the power supply node (vpwr) and the ground node (vgnd).

The current replication stage 520 ensures that the current ($I_{BG}$) generated in current generation circuit 510 is replicated with high accuracy (identical or linearly scaled) at the output node (OUT) of Current output Bandgap circuit 500. A current mirror stage, which includes NMOS transistors M15 and M16 in circuit 520, copies the output current ($I_{OUT}$) and generates the reference current ($I_{REF}$).

As described in more detail below, Current output Bandgap circuit 500 may demonstrate significant advantages over Current output Bandgap circuit 400. Some of the advantages may include, e.g., a decreased sensitivity of the output current ($I_{OUT}$) to the input offset voltage ($V_{OS1}$) of the operational amplifier (Opamp1) used in current generation circuit 510, an increase in the rejection of power supply noise (PSRR) in a region close to DC, and better current replication accuracy of the current generated by current generation circuit 510 at the output node of Bandgap circuit 500. Additional improvements and advantages will become apparent in the light of the following disclosure.

In the embodiment of FIG. 5, the negative temperature coefficient current (CTAT) $I_{2B}$ is generated through resistor R1, which is connected between the power supply node (vpwr) and node $V_B$, such that:

$$I_{2B}=[V_{D1}-V_{OS1}]/R1 \tag{21}$$

where $V_{D1}$ is the forward voltage across p-n junction diode D1, which has a negative temperature coefficient (e.g. in the range of −1.5 mV/C), and $V_{OS1}$ is the input offset voltage of the operational amplifier (Opamp1) in current generation circuit 510.

Since the resistor connected between the positive power supply node (vpwr) and node $V_A$ is chosen to be M times smaller in value than the resistor (R1) connected between the positive power supply node (vpwr) and node $V_B$, and due to the operational amplifier (Opamp1) ensuring that the potentials at nodes $V_A$ and $V_B$ are substantially equal (less the effect of $V_{OS1}$, the input offset of Opamp1), it holds true that, if the influence of $V_{OS1}$, is neglected:

$$I_{1B}=M*I_{2B} \tag{22}$$

The drain current through NMOS transistor M1 may be chosen to be M times larger than the drain current through NMOS transistor M2. Therefore, $$I_{1B}+I_{1A}=M*(I_{2A}+I_{2B}) \tag{23}$$

From (22) and (23):

$$I_{1A}=M*I_{2A} \tag{24}$$

In equations (22) through (24) above, $I_{1A}$ is the current through p-n junction diode D1, $I_{1B}$ is the current through resistor R1/M, $I_{2A}$ is the current through resistor R2 and p-n junction diode D2, and $I_{2B}$ is the current through resistor R1, as shown in FIG. 5.

In the embodiment of FIG. 5, the positive temperature coefficient current (PTAT) $I_{2A}$ generated through resistor R2 is expressed as:

$$I_{2A}=[V_{D1}-V_{D2}-V_{OS}]/R2=Vt*[ln(M*N)]/R2-V_{OS1}/R2 \tag{25}$$

where $V_{D1}$ is the forward voltage across p-n junction diode D1, $V_{D2}$ is the forward voltage across p-n junction diode D2, N is the ratio between the areas of diodes D2 and D1, M is the multiplicity factor between the currents in the current sources implemented with NMOS transistors M1 and M2, respectively, and $V_{OS1}$ is the input offset voltage of Opamp1. In addition, Vt is the thermal voltage (k*T/q), where T is the absolute temperature (degrees Kelvin), $k=1.38*10^{-23}$ J/K, and $q=1.6*10^{-19}$ C.

Consequently, the current through NMOS transistor M2 in current generation circuit 510 may be expressed as:

$$I_{BG}=I_{2A}+I_{2B}=V_{D1}/R1+Vt*[ln(M*N)]/R2-V_{OS1}(1/R1+1/R2) \tag{26}$$

By comparing equations (14) and (26), one may conclude that the influence of the operational amplifier (Opamp1) input offset voltage ($V_{OS1}$) on the current ($I_{BG}$) generated by the current generation circuit 510 of FIG. 5 is significantly reduced compared to the operational amplifier (Opamp) input offset voltage ($V_{OS}$) influence on the current output ($I_2$) generated by the current generation circuit 410 of FIG. 4. This is due to the use of the current multiplication factor M between the two NMOS current sources (M1 and M2) in circuit 510 of FIG. 5. In other words, the condition:

$$Vt*[ln(M*N)]/R2>>V_{OS1}(1/R1+1/R2) \tag{27}$$

in equation (26) for circuit 510 of FIG. 5 becomes much easier to comply with than the condition:

$$Vt*[ln(N)]/R3>>V_{OS}*(1/R2+1/R3) \tag{28}$$

in equation (14) for circuit 410 of FIG. 4. In particular design cases, acceptable values for M may be chosen from a range of values extending between 4 to 16. However, the overall power consumption of current generation circuit 510 and its area may be taken into consideration upon choosing a particular value for M. Equation (26) can only be satisfied if the value of the resistor connected between the power supply (vpwr) and $V_A$ nodes is chosen to be M times smaller than the value of the resistor connected between the vpwr and $V_B$ nodes, such that a ratio of M is ensured between the current through p-n junction diode D1 and the current through p-n junction D2.

As another improvement over current generation circuit (410) of FIG. 4, the current generation circuit (510) of FIG. 5 uses NMOS transistors, instead of PMOS transistors, for current sources M1 and M2. This feature allows current generation circuit 510 to function at lower power supply voltages than circuit 410, due to the lower saturation voltage (Vdsat) value for an NMOS transistor compared to the saturation voltage (Vdsat) of an equivalent PMOS transistor having the same drain current, aspect ratio and transistor length. Circuit 510 may function at a power supply voltage, which may be lower (e.g., a few tens of mV lower in a particular 0.13 μm CMOS technology implementation) than the lowest power supply voltage needed to operate circuit 410 implemented in the same technology.

The minimum power supply voltage value for current generation circuit 510 may be written as:

$$\begin{aligned} V(\text{vpwr_510}) &= V_{D1} + V_{DS}(M1) \\ &= V_{D1} + Vdsat(M1) + 50\text{mV} \\ &= V_{D1} + V_{GS}(M1) - Vth(M1) + 50\text{mV} \end{aligned} \tag{29}$$

where V(vpwr_510) is the minimum power supply voltage value for circuit 510, $V_{D1}$ is the voltage across p-n junction diode D1, $V_{DS}$(M1) is the drain-to-source voltage of NMOS transistor M1, and Vdsat (M1) is the saturation voltage of transistor M1. The saturation voltage, Vdsat, is defined as the difference between $V_{GS}$ and Vth for a MOS transistor, i.e. the minimum drain to source voltage for which the MOS transistor is in saturation. In equation (29), $V_{GS}$(M1) is the gate-to-source voltage of transistor M1; Vth(M1) is the threshold voltage of transistor M1; and a margin of 50 mV above Vdsat(M1) was considered sufficient to ensure transistor M1 is safely in the saturation region.

On the other hand, the minimum power supply voltage value for current generation circuit 410 can be written as:

$$\begin{aligned} V(\text{vpwr_410}) &= V_{D1} + V_{DS}(M1) \\ &= V_{D1} + Vdsat(M1) + 50\text{mV} \\ &= V_{D1} + V_{GS}(M1) - Vth(M1) + 50\text{mV} \end{aligned} \tag{30}$$

where V(vpwr_410) is the minimum power supply voltage value of circuit 410, $V_{D1}$ is the voltage across p-n junction diode D1, $V_{DS}$(M1) is the drain-to-source voltage of NMOS transistor M1, and Vdsat(M1) is the saturation voltage of transistor M1. In equation (30), a margin of 50 mV above Vdsat(M1) was considered sufficient to ensure transistor M1 is safely in the saturation region.

For the same drain current, same aspect ratio (W/L), same gate length (L), and assuming both NMOS transistor M1 in circuit 510 and PMOS transistor M1 in circuit 410 are in saturation, the Vdsat for the NMOS transistor will be lower than the Vdsat for the PMOS transistor because the mobility of electrons ($\mu_n$) is higher than the mobility of holes ($\mu_p$) in the equation for drain current for a MOS transistor.

$$Id_{(NMOS\ M1)} = \mu_n * (W/L) * Vdsat^2_{(NMOS\ M1)} \tag{31}$$

$$Id_{(PMOS\ M1)} = \mu_p * (W/L) * Vdsat^2_{(PMOS\ M1)} \tag{32}$$

where $Id_{(NMOS\ M1)}$ is the drain current of NMOS transistor M1 in FIG. 5, and $Id_{(PMOS\ M1)}$ is the drain current of PMOS transistor M1 in FIG. 4. Note, however, that the channel length modulation effect is neglected in equations (31) and (32). If $V_{D1}$ is substantially the same for current generation circuits 410 and 510, it can be inferred from equations (30), (31) and (32) that V(vpwr_410)>V(vpwr_510), which would imply that circuit 510 can work at lower power supply values than circuit 410.

As yet another improvement over the current generation circuit 410 of FIG. 4, current generation circuit 510 includes a current multiplication factor of M between the adjacent branches with single NMOS current sources M1 and M2, respectively. It was already demonstrated in equations (22) through (28), that using a current multiplication factor of M between the adjacent branches with single NMOS current sources M1 and M2 decreases the sensitivity of the current generation circuit 510 output current ($I_{BG}$) to the input offset voltage $V_{OS1}$ of the operational amplifier Opamp1. As demonstrated below, current replication circuit 520 introduces little error in terms of current replication accuracy due to the use of a second operational amplifier, Opamp2. Thus, the overall sensitivity of Current output Bandgap circuit 500 to the input offset voltage $V_{OS1}$ of the operational amplifier Opamp1 used in current generation circuit 510 is reduced.

As yet another advantage, Current output Bandgap circuit 500 of FIG. 5 includes a more complex current replication circuit 520 than circuit 420 of FIG. 4. Current replication circuit 520 enables the output current $I_{BG}$ of the current generation circuit (as described in equation (26)) to be replicated at the current output node (OUT) of the Current output Bandgap circuit with significantly higher accuracy than previously possible (e.g. in the case of using circuit 420 in FIG. 4.).

In the example embodiment of FIG. 5, current replication circuit 520 includes PMOS cascode current source 523 (with transistors M11 and M12) and a PMOS bias generator stage 524 (with transistors M8, M9 and M10). Diode-connected PMOS transistor M8 provides the bias voltage for the gates of PMOS transistors M9 and M11. The gates of PMOS transistors M10 and M12 are connected to the drain of PMOS transistor M9. The sources of PMOS transistors M8, M10 and M12 are connected to the power supply node (vpwr), the drain of PMOS transistor M10 is connected to the source of PMOS transistor M9 and the drain of PMOS transistor M12 is connected to the source of PMOS transistor M11. Transistors M10 and M12 are substantially identical, whereas transistors M9 and M11 are substantially identical.

Current replication circuit 520 also includes a first NMOS cascode current source 522 (with transistors M13 and M14) and a second NMOS cascode current source 521 (with transistors M6 and M7). NMOS transistors M7, M14 are substantially identical, while NMOS transistors M6, M13 are substantially identical. The gates of NMOS transistors M6 and M13 are connected together, the gates of NMOS transistors M7 and M14 are connected together. The source terminal of transistor M7 is connected to the drain terminal of transistor M6. The source terminal of transistor M14 is connected to the drain terminal of transistor M13. The source terminals of transistors M6, M13 are connected to the ground node (vgnd). An operational amplifier, Opamp2, is also included within the current replication circuit 520 of FIG. 5.

More specifically, the PMOS cascode current source (transistors M11, M12) is connected between the power supply node (vpwr) and the output node (OUT) of Current output Bandgap circuit 500. The output of the first NMOS cascode current source 522 is connected to the drain of PMOS transistor M9 in the PMOS bias generator stage 524. The output of the second NMOS cascode current source 521 is connected to the drain and gate of PMOS transistor M8. In this manner, diode-connected PMOS transistor M8 may be connected in series with the second cascode current source 521 for generating the gate voltages for PMOS transistors M9 and M11. The biasing stage (with PMOS transistors M9 and M10) is connected in series with the first NMOS cascode current source 522 for generating the gate voltages for PMOS transistors M10 and M12.

NMOS transistor M13 of the first NMOS cascode current source and NMOS transistor M6 of the second NMOS cascode current source have their gates connected to the gates of the single NMOS current sources (M1, M2) in current generation circuit 510, thus ensuring correct current copying of the current generation circuit 510 current ($I_{BG}$) to the first and second NMOS cascode current sources in current replication circuit 520 (due to the fact that the gate-to-source voltages of NMOS transistors M1, M2, M6, M13 are essentially the same). The gates of the two upper NMOS transistors in the first and second NMOS current sources (M7 and M14) are connected to the output of the second operational amplifier Opamp2 in current replication circuit 520.

The second operational amplifier (Opamp2) enables the reference current ($I_{BG}$) generated in current generation circuit 510 to be copied with relatively high accuracy to the first and second NMOS cascode current sources in current replication circuit 520. As shown in FIG. 5, the inverting input of Opamp2 is connected to the drain of NMOS transistor M6 in the second NMOS cascode current source, the non-inverting input of Opamp2 is connected to node $V_B$ in current generation circuit 510, and the output of Opamp2 is connected to the gates of transistors M7 and M14. In this manner, Opamp2 is configured for adjusting the gate voltage of NMOS transistor M7 (which is also connected to the gate of NMOS transistor M14) until the drain-to-source voltages of NMOS transistors M6 and M2 are substantially equal, less the error introduced by the input offset voltage ($V_{OS2}$) of Opamp2.

Since the drain-to-source voltages of transistors M2, M6 and M13 are substantially equal (due to the use of Opamp2 in the configuration described above), the current ($I_{BG}$) generated in the current generation circuit 510 may be copied with relatively high accuracy to the NMOS cascode current sources implemented with M6, M7 and M13, M14, respectively. In other words, $$I_{CAS}=I_{BG}*(1+\lambda*V_{DS}(M2))/(1+\lambda*V_{DS}(M6))==I_{BG}, \tag{33}$$

where $I_{CAS}$ is the drain current of transistor M6, $I_{BG}$ is the drain current of transistor M2, $V_{DS}$(M2) is the drain-to-source voltage of transistor M2, $V_{DS}$(M6) is the drain-to-source voltage of transistor M6 and λ is the channel length modulation coefficient for transistors M2, M6, M13. In the above equation, $V_{DS}$(M2) is substantially equal to $V_{DS}$(M6), less the effect of the Opamp2 input offset voltage ($V_{OS2}$), whose contribution to current mismatch, in this case, is negligible.

To ensure proper current copying, NMOS transistors M6, M13 may have the same length as transistors M1, M2, so that transistors M1, M2, M6, M13 have the same threshold voltage (Vth). Depending on the ratio between the transistor width of transistor M2 on one hand, and the transistor width of transistors M6 and M13 on the other hand, the current value ($I_{CAS}$) copied to the first and second NMOS cascode current sources may be a linearly scaled version of the current ($I_{BG}$) generated in current generator circuit 510 (i.e. the drain current of transistor M2), or an identical replica of $I_{BG}$.

Due to the specific circuit configuration described above for current replication circuit 520, the current $I_{CAS}$ copied to NMOS cascode current sources 521 and 522 is substantially equal to the current $I_{OUT}$ at the output node of Current output Bandgap 500. The reason is that the current through transistors M9, M10 of PMOS bias generator 524 is the same as the current flowing through the first NMOS cascode current source 522 since NMOS transistors M13, M14 and PMOS transistors M9, M10 are connected in series in FIG. 5. Since PMOS transistors M10 and M12 are substantially identical, and PMOS transistors M9 and M11 are substantially identical, transistors M10 and M12 have the same gate voltage, transistors M9 and M11 have the same gate voltage, the output current $I_{OUT}$ of Bandgap circuit 500 is substantially equal to $I_{CAS}$. In other words, the reference current $I_{BG}$ generated in current generation circuit 510 is transferred with high accuracy (identical copy or a linearly scaled version of it) through circuit 520, in order to generate the output current $I_{OUT}$ of Current output Bandgap circuit 500, due to the use of an additional operational amplifier (Opamp2) in current replication circuit 520. The operational amplifier (Opamp2) is configured in conjunction with current generation circuit 510, PMOS cascode current source 523 and the PMOS bias generator circuit (524) in current replication circuit 520 in order to implement the high accuracy current copying function mentioned above.

As another advantage, the use of the second operational amplifier (Opamp2) in current replication circuit 520 increases the Power Supply Rejection Ratio (PSRR) of the Current output Bandgap circuit 500 shown in FIG. 5. Moreover, the second operational amplifier (Opamp2) has the effect of increasing the output impedances of the first NMOS cascode current source 521 and second cascode current source 522 by a factor of A, where A is the voltage amplification factor of the operational amplifier (Opamp2). As a consequence, the variation of the output current $I_{OUT}$ due to noise on the power supply for circuit 500 may be expressed as:

$$\begin{aligned}\Delta(I_{OUT}) &= \Delta(V_{GS}(M12))*gm(M12) \\ &= \Delta(V(vpwr))*gm(M12)* \\ &\quad (Zout(M10, M9))/(Zout(M10, M9)+ \\ &\quad A*Zout(M14, M13))\end{aligned} \tag{34}$$

where $I_{OUT}$ is the output current of Current output Bandgap circuit 500; $V_{GS}$(M12) is the gate-to-source voltage for transistor M12 in the PMOS cascode current source and gm(M12) is the transconductance value of PMOS transistor M12. In addition, V(vpwr) is the instantaneous voltage on the power supply, Zout(M10, M9) is the output impedance of the PMOS biasing stage with transistors M10, M9; Zout(M14, M13) is the output impedance of NMOS cascode current source 522; and A is the voltage gain of Opamp2. Equation (34) shows that the PSRR of Current output Bandgap circuit 500 is increased by the use of the second operational amplifier (Opamp2) in current replication circuit 520. In other words, $\Delta I_{OUT}$ in equation (34) is significantly decreased due to the voltage gain of the second operational amplifier (Opamp2).

As yet another advantage, the output impedance of the output current source used to generate the output current $I_{OUT}$ is much greater in Current output Bandgap circuit 500 than in Current output Bandgap circuit 400. This is primarily due to the fact that the output current source in circuit 500 is a PMOS cascode current source, rather than the single PMOS transistor used in circuit 400. PMOS cascode current source 523 functions to isolate the output (OUT) of Current output Bandgap circuit 500 from the noise voltage which may appear on the power supply bus due to switching of other circuits sharing the same power supply on the semiconductor device. This advantage may be particularly apparent in large chip applications, where large digital blocks create considerable switching noise on the power supply bus, which must not be allowed to influence the bias lines of sensitive analog blocks (e.g. Voltage Controlled Oscillators). In other words, Bandgap circuit 500 of FIG. 5 represents a much better filter for the power supply noise fed through its output node than Bandgap circuit 400 of FIG. 4.

Figure 6:
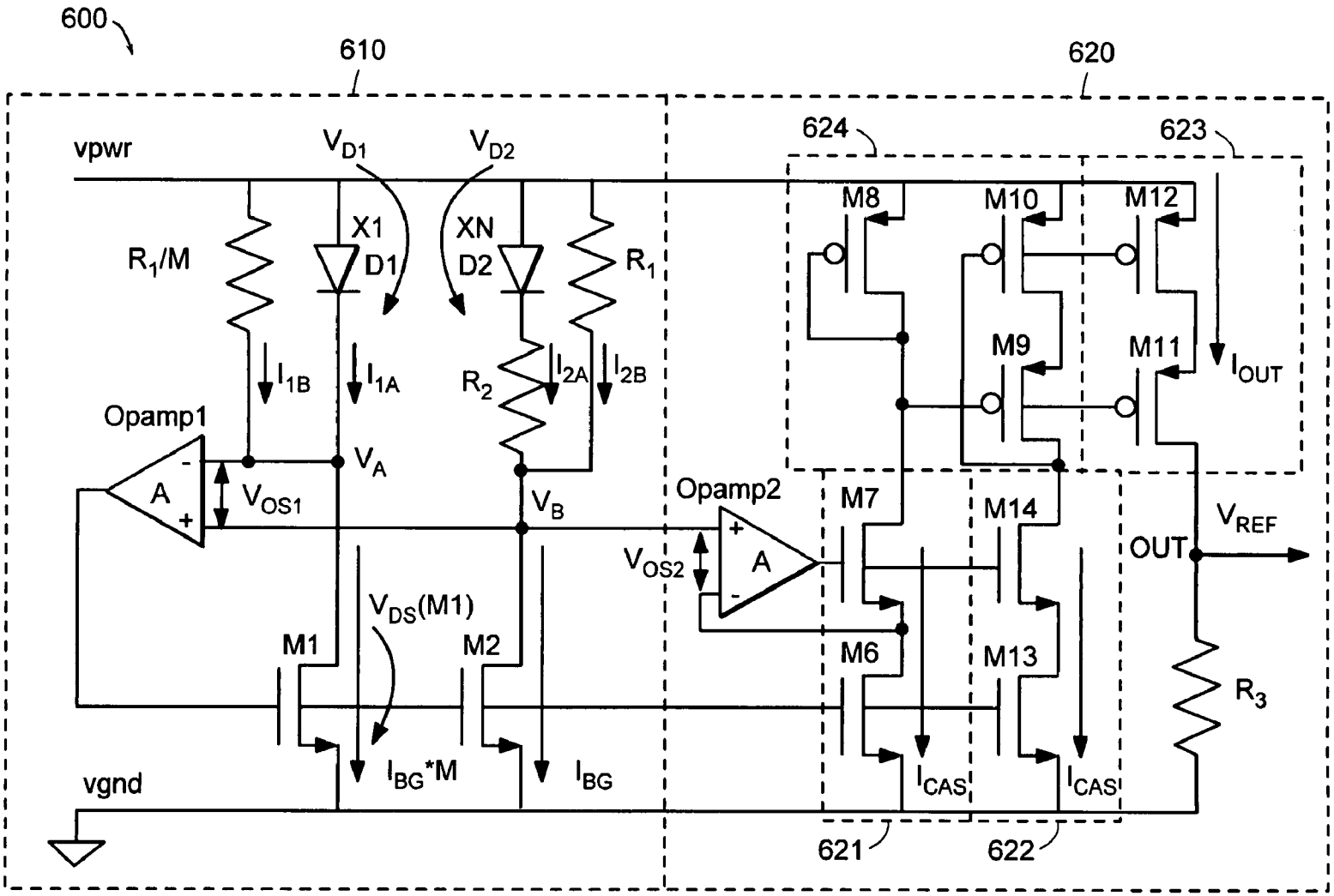
FIG. 6 is a circuit diagram illustrating one embodiment of a Voltage output Bandgap circuit in accordance with the present invention.

FIG. 6 shows one embodiment of a Voltage output Bandgap circuit implemented according to the present invention. The reference voltage ($V_{REF}$) is generated by passing the reference current ($I_{OUT}$) through a resistor (R3) according to equation (6). Since circuit 500 in FIGS. 5 and circuit 600 in FIG. 6 have similar circuit topologies, with the exception of NMOS transistors M15 and M16 (a current mirroring stage used to generate a copy of $I_{OUT}$) in FIG. 5 and resistor R3 (used to generate $V_{REF}$) in FIG. 6, the discussion and conclusions presented above regarding circuit 500 of FIG. 5 also hold true for circuit 600 of FIG. 6.

Figure 7:
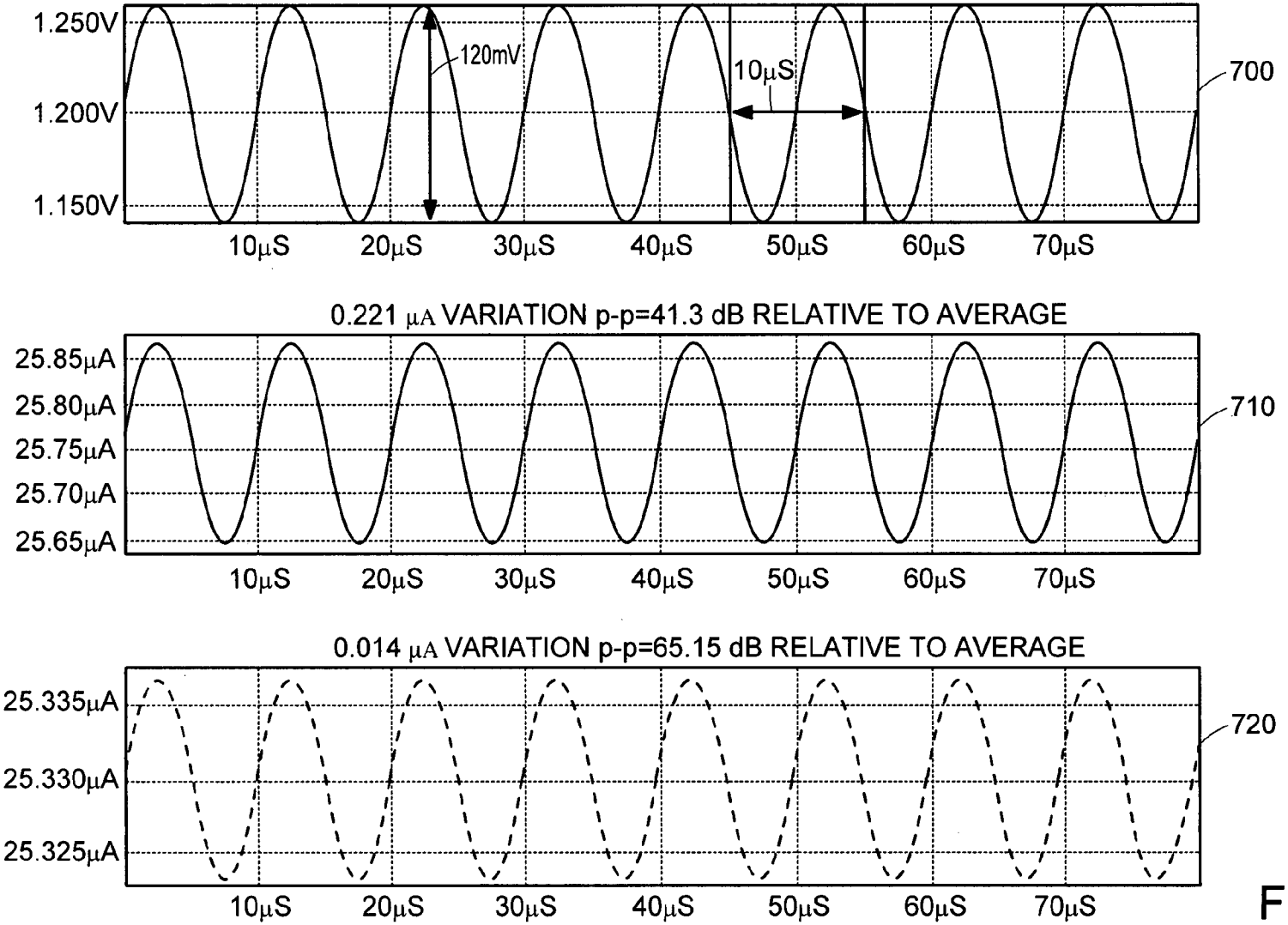
FIG. 7 is a set of graphs illustrating the difference in output current ($I_{OUT}$) variation in the presence of power supply noise for the Current output Bandgap circuits of FIGS. 4 and 5.

FIG. 7 shows that the power supply rejection capability of Current output Bandgap circuit 500 (e.g., −65 dB PSRR, as shown in panel 720) is substantially higher than the power supply rejection capability of Current output Bandgap circuit 400 (e.g., −41 dB PSRR, as shown in panel 710) in the presence of power supply noise. The test conditions are 100 kHz, 120 mV peak-to-peak amplitude sinusoidal noise superimposed on the power supply, as shown in panel 700. In other words, Current output Bandgap circuit 500 produces substantially less variation in output current (i.e., smaller $\Delta I_{OUT}$) than Current output Bandgap circuit 400 in the presence of power supply noise, if the average values for the output currents ($I_{OUT}$) are substantially the same. The results are reported for a 0.13μ CMOS implementation and shown for the typical process corner, 1.2 V power supply and 55 C temperature.

Figure 8:
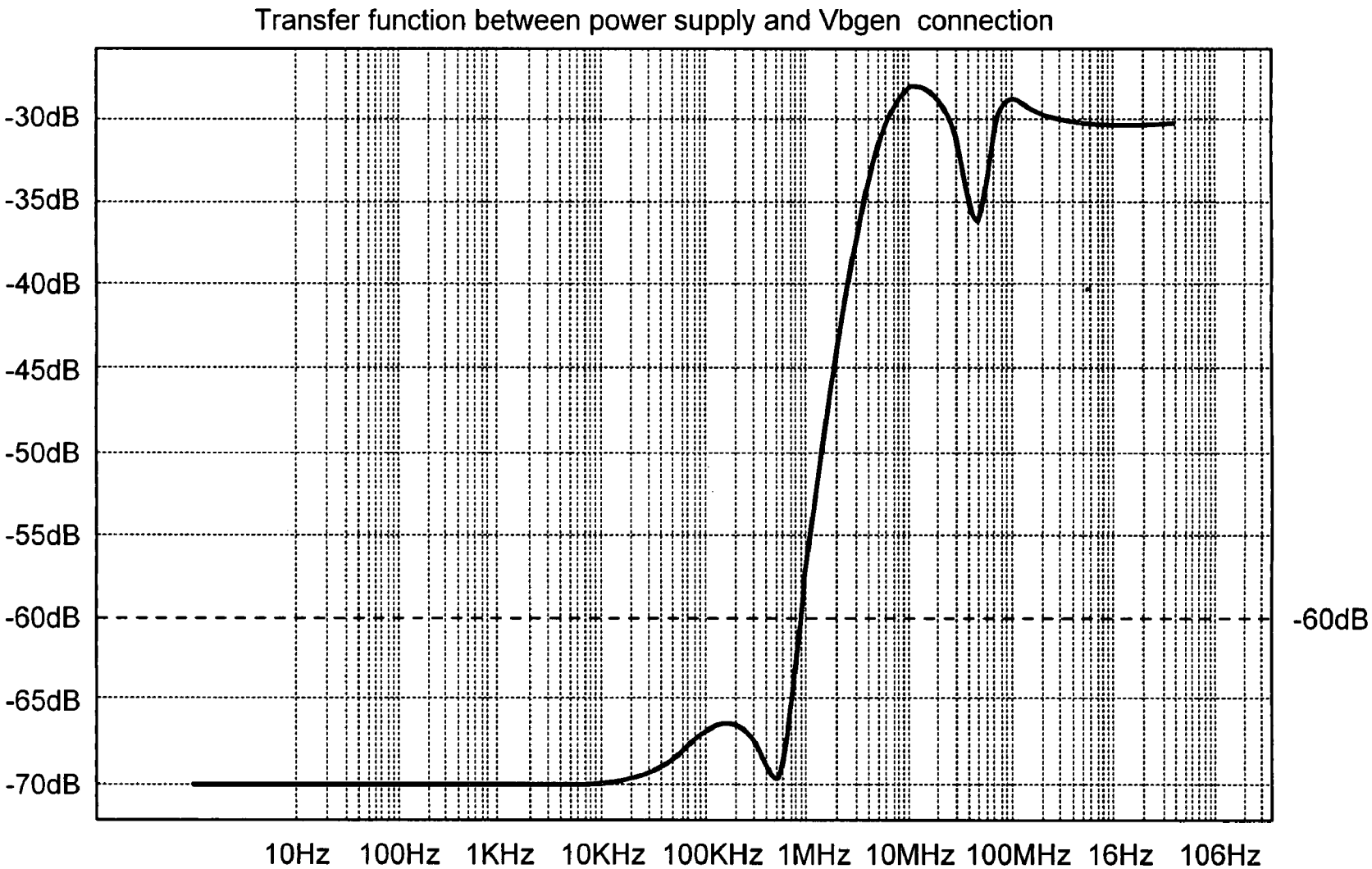
FIG. 8 is a graph illustrating the transfer function between the power supply node and the output node OUT as a function of frequency for the Current output Bandgap circuit of FIG. 5.

FIG. 8 shows the power supply voltage gain to output node (PSG_Vbgen) for Current output Bandgap circuit 500 as a function of frequency. FIG. 8 shows that the transfer function between the power supply node (vpwr) and the output node (OUT) is substantially less than −60 dB in the 0 to 100 kHz frequency range. The results are reported for a 0.13μ CMOS implementation and shown for the typical process corner, 1.2 V power supply and 55 C temperature.

Figure 9:
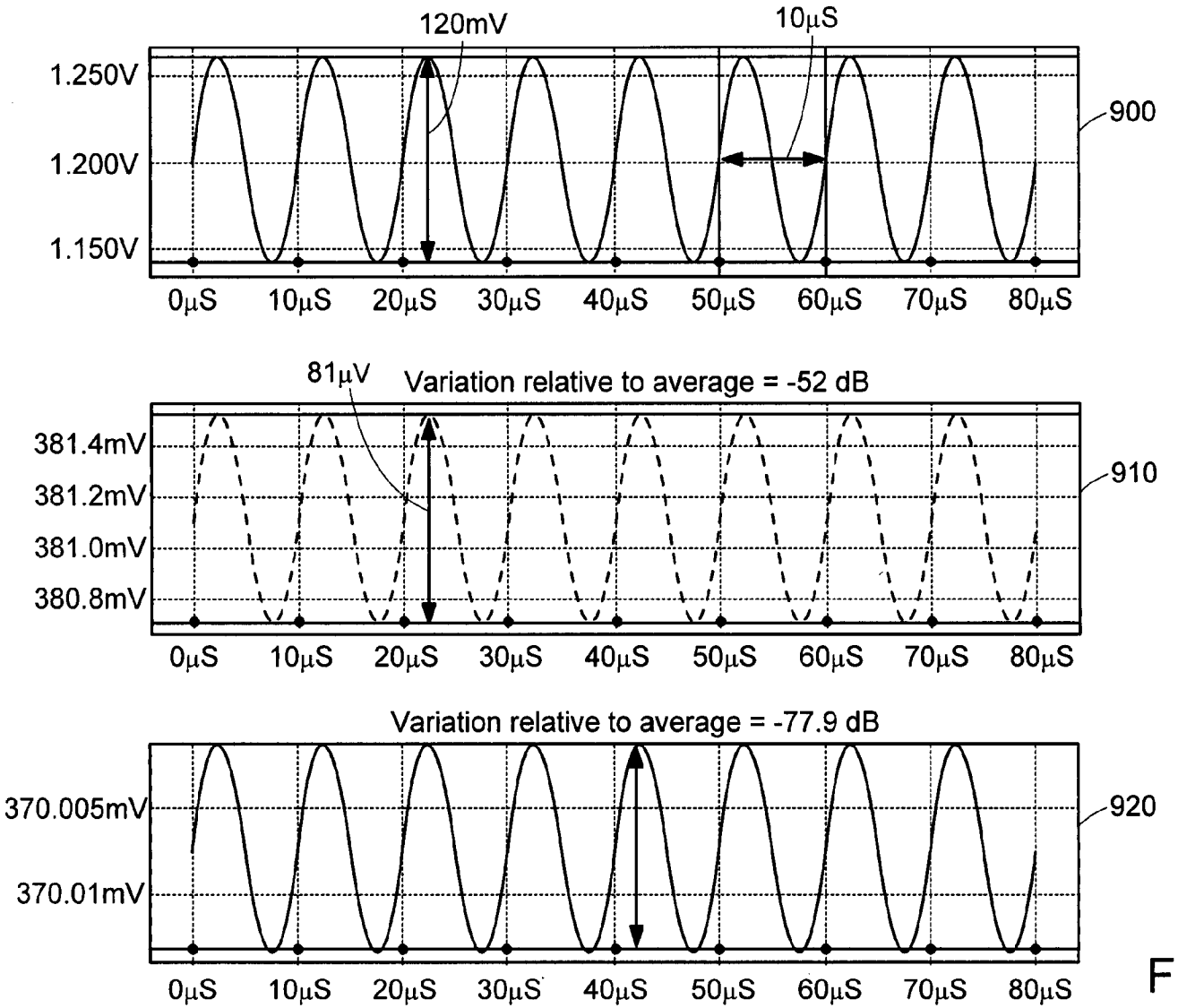
FIG. 9 is a set of graphs illustrating the difference in the variation of voltage at the output node OUT in the presence of power supply noise for the Current output Bandgap circuits of FIGS. 4 and 5.

FIG. 9 illustrates that the power supply voltage gain to output node (PSG_Vbgen) for Current output Bandgap circuit 500 (e.g., −77.9 dB, as shown in panel 920) is substantially lower than the PSG_Vbgen for Current output Bandgap circuit 400 (e.g., −52 dB, as shown in panel 910) in the presence of power supply noise. The test conditions are 100 kHz, 120 mV peak-to-peak amplitude sinusoidal noise superimposed on the power supply, as shown in panel 900. In other words, circuit 500 provides a significantly higher degree of isolation for the voltage at node OUT in the presence of voltage noise present on the power supply, as compared to circuit 400, when tested in the same conditions. The results are reported for a 0.13μ CMOS implementation and shown for the typical process corner, 1.2 V power supply and 55 C temperature.

Figure 10:
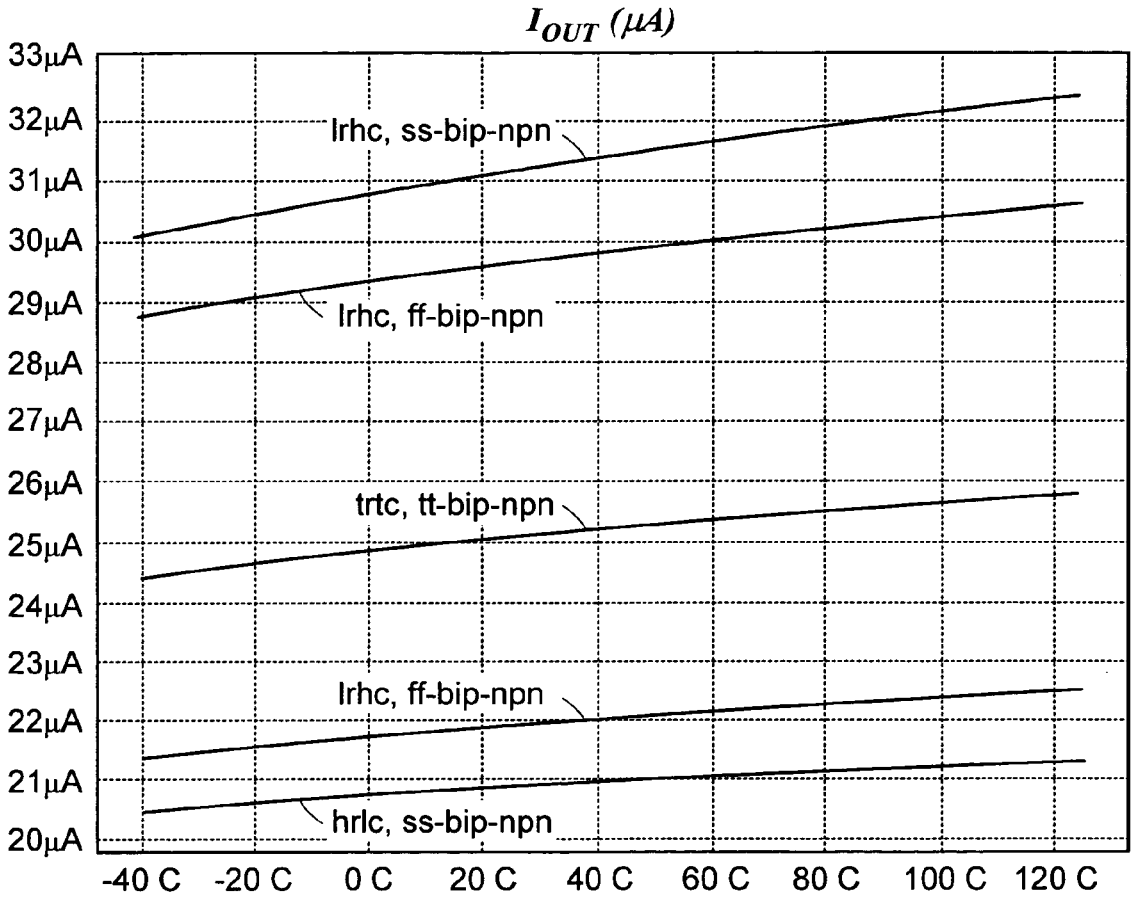
FIG. 10 is a graph illustrating the DC output current ($I_{OUT}$) variation with temperature, over power supply and process corners for the Current output Bandgap circuit of FIG. 5.

FIG. 10 shows the variation of the output current ($I_{OUT}$) for Current output Bandgap circuit 500 with temperature, across power supply (1.08 V to 1.32 V) and process corners. The results are reported for a 0.13μ CMOS implementation.

Figure 11:
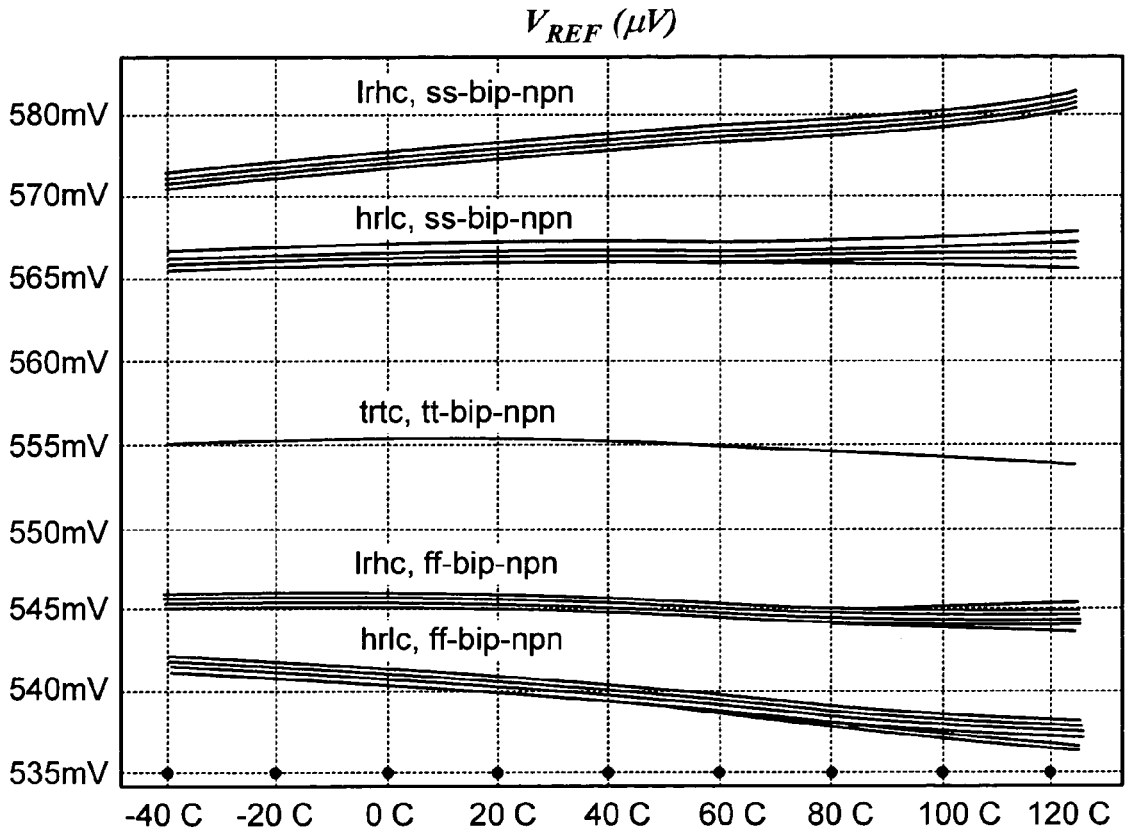
FIG. 11 is a graph illustrating the reference voltage ($V_{REF}$) variation with temperature, over power supply and process corners for the Voltage output Bandgap circuit of FIG. 6.

FIG. 11 shows the variation of the reference voltage ($V_{REF}$) generated by passing the output current $I_{OUT}$ (nominally 25 μA) through a 21.9 KOhm resistor, for an implementation of Current output Bandgap circuit 500, with temperature, power supply (1.08 V to 1.32 V) and process corners. The results are reported for a 0.13μ CMOS implementation.

Figure 12:
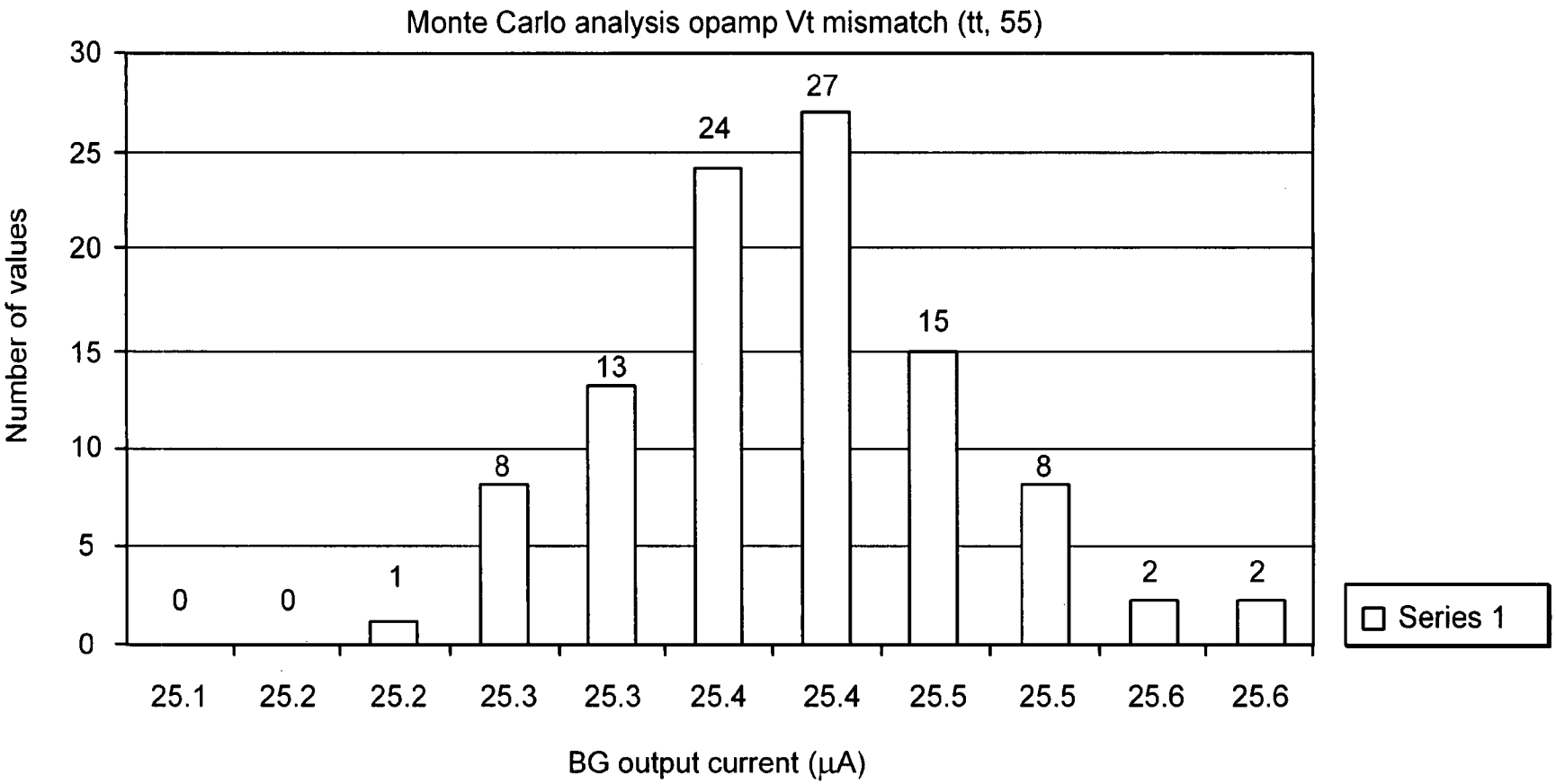
FIG. 12 shows Monte Carlo simulation results for the reference current ($I_{OUT}$) sensitivity to MOS transistor threshold voltage (Vth) mismatch in the differential input pair of the operational amplifier (Opamp1) used in the current generation circuit of the Current output Bandgap circuit of FIG. 5.

FIG. 12 shows Monte Carlo simulation results for the output current $I_{OUT}$ sensitivity to MOS transistor threshold voltage mismatch in the differential input pair of the operational amplifier (Opamp1) used in the current generation circuit (510) of Current output Bandgap circuit 500 in FIG. 5. The results are reported for a 0.13μ CMOS implementation.

Figure 13:
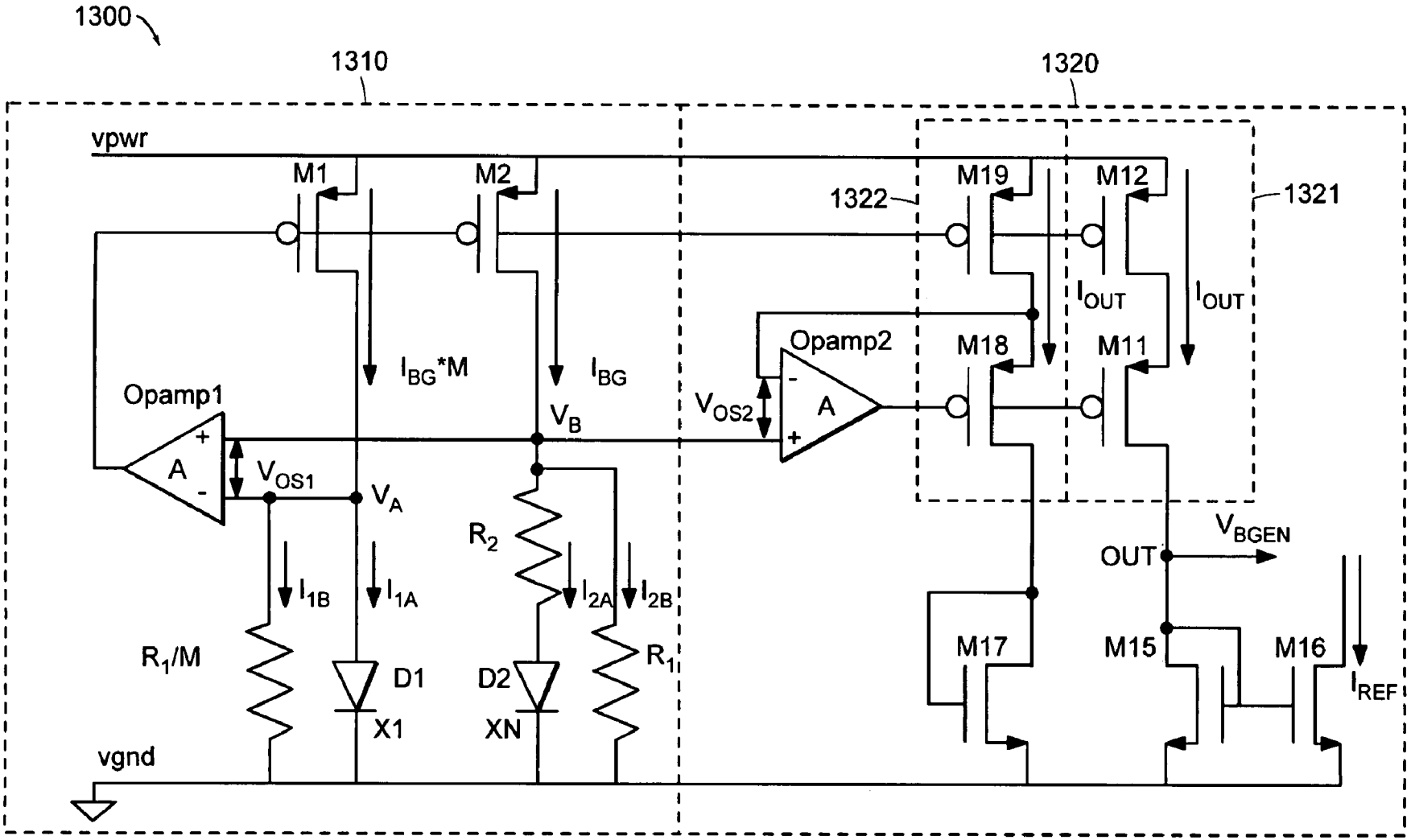
FIG. 13 is a circuit diagram illustrating another embodiment of a Current output Bandgap circuit implemented in accordance with the present invention.

FIG. 13 is a circuit diagram illustrating another embodiment of a Current output Bandgap circuit implemented in accordance with the present invention. The embodiment of FIG. 13 differs from the embodiment of FIG. 5 by the use of single PMOS current sources (M1 and M2) in current generation circuit 1310. The current replication circuit 1320 shown in FIG. 13 also differs from current replication circuit 520 by including a first PMOS cascode current source 1321 (implemented with transistors M11 and M12), a second PMOS cascode current source 1322 (implemented with transistors M18 and M19), and a diode-connected NMOS transistor (M17). However, current replication circuit 1320 uses the same circuit idea as circuit 520 of FIG. 5 by using a second operational amplifier, Opamp2, to ensure significantly high current copying accuracy for circuit 1320. Opmap2 ensures that the source-to-drain voltages of transistors M2, M19, and M12 are substantially the same, less the error due to the input offset voltage of Opamp2. As a consequence, the current ($I_{BG}$) generated in current generation circuit 1310 is replicated with high accuracy (identical copy or a linearly scaled replica) as the output current ($I_{OUT}$) of Current output Bandgap 1300. A current mirror stage, which includes NMOS transistors M15 and M16 in circuit 1320, copies the output current ($I_{OUT}$) and generates the reference current ($I_{REF}$).

Figure 14:
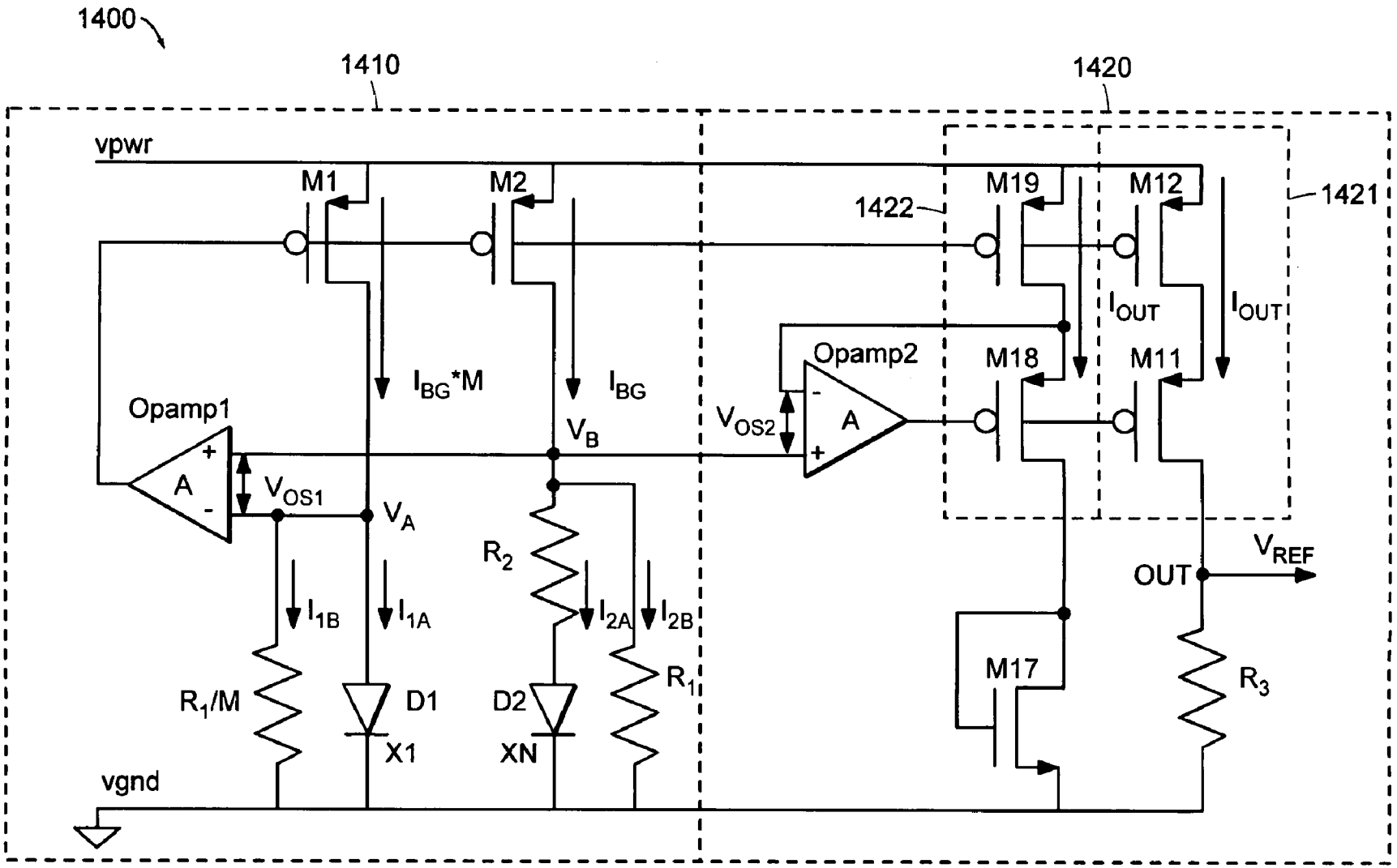
FIG. 14 is a circuit diagram illustrating another embodiment of a Voltage output Bandgap circuit implemented in accordance with the present invention.

FIG. 14 is a circuit diagram illustrating another embodiment of a Voltage output Bandgap circuit implemented in accordance with the present invention. The embodiment of FIG. 14 differs from the embodiment of FIG. 6 by the use of single PMOS current sources (M1 and M2) in current generation circuit 1410. The current replication circuit 1420 shown in FIG. 14 also differs from current replication circuit 620 by including a first PMOS cascode current source 1421 (implemented with transistors M11 and M12), a second PMOS cascode current source 1422 (implemented with transistors M18 and M19), and a diode-connected NMOS transistor (M17). However, current replication circuit 1420 uses the same circuit idea as circuit 620 of FIG. 6 by using a second operational amplifier, Opamp2, to ensure significantly high current copying accuracy of circuit 1420. Opmap2 ensures that the source-to-drain voltages of transistors M2, M19 and M12 are substantially the same, less the error due to the input offset voltage of Opamp2. As a consequence, the current ($I_{BG}$) generated in current generation circuit 1410 is replicated with high accuracy (identical copy or a linearly scaled replica) as the output current ($I_{OUT}$) of current replication stage 1420. FIG. 14 differs from FIG. 13 by developing a reference voltage ($V_{REF}$) across a resistor (R3). As a result of current replication circuit 1420, errors in the reference voltage ($V_{REF}$) may also be minimized.

Though fewer transistors are needed in the current replication stages of FIGS. 13 and 14, the use of PMOS current sources in current generation circuits 1310 and 1410 tends to increase the minimum power supply voltage for which circuits 1300 and 1400 can still be functional. In one example, the minimum power supply voltage, which would allow circuits 1300 and 1400 to still be functional, can be approximately 1.125 V for a 0.13μ CMOS implementation. Circuits 1300 and 1400 may be used for CMOS technologies which do not provide NPN BJT devices, and thus would prohibit implementation of the architectures shown in FIGS. 5 and 6. P-n junction diodes D1 and D2 in circuits 1300 and 1400 may be implemented using lateral PNP devices, which are usually available in modern CMOS technologies.

An improved Current output Bandgap circuit has now been described, which includes a current generation circuit and a current replication circuit. The output current of the Current output Bandgap is generated in such a manner that when passed through a resistor, the reference voltage thus generated is less-temperature dependent, less process dependent and less-power supply dependent. The current generation circuit is a modified diode bridge with one diagonal connected to the power supply and ground pins, and the other diagonal connected to the inputs of a first operational amplifier whose output controls the currents through two single MOS current sources placed on two adjacent branches. The other two adjacent branches are configured in such a manner that the reference current is generated as a sum of a current proportional to absolute temperature (PTAT) and a current linearly decreasing with absolute temperature (CTAT). The output current of the current generation circuit is the current through one of the single MOS current sources and is a sum of a PTAT (proportional to absolute temperature) current and a CTAT (with negative temperature coefficient) current. In some embodiments, the use of single NMOS current sources allows the current generation circuit, and in the end the Current output Bandgap, to function at lower minimum power supply voltages. Current multiplication may be used in the current generation circuit to reduce the influence of the first operational amplifier input offset voltage on the Current output Bandgap output current, thus increasing the performance of the Current output Bandgap in terms of reference output current generation accuracy.

The current replication circuit transfers with high accuracy the current generated in the current generation block to the output of the Current output Bandgap.

As another advantage, the use of a second operational amplifier in the current replication circuit enables a substantially higher rejection of power supply noise (PSRR) and a substantially higher output current accuracy to be achieved for the Current output Bandgap circuit. In some embodiments, PMOS and NMOS cascode current sources may be used in conjunction with a second operational amplifier in the current replication circuit to increase the Current output Bandgap rejection of power supply noise (PSRR). In other embodiments, a PMOS cascode current source may be used in conjunction with the second operational amplifier to increase the Current output Bandgap rejection of power supply noise (PSRR).

As a further advantage, the PMOS cascode current source used to generate the output current provides high output impedance and, therefore, enables the improved Current output Bandgap circuit to achieve significantly lower PSG_Vbgen (i.e., the transfer function in voltage between the power supply node and the output node of the Current output Bandgap). This functions to improve the isolation of the output of the Current output Bandgap circuit from noise voltage appearing on the power supply bus. For at least these reasons, the Current output Bandgap circuit provided herein may be successfully used to generate bias currents for low-power, noise sensitive circuits, such as voltage-controlled oscillators.

In some embodiments, the Current output Bandgap circuit described herein can be configured to generate nominally constant voltages by passing the reference output current ($I_{OUT}$) through specified resistors. Owning to the advantages described above for the Current output Bandgap circuit, the reference voltages ultimately created would exhibit a high degree of insensitivity to the power supply noise and a high degree of accuracy. For at least these reasons, the reference voltages generated in accordance with the present invention may be successfully used in applications requiring accurate reference voltages with low variation with temperature, process corners and power supply voltage.

It will be appreciated to those skilled in the art having the benefit of this disclosure that this invention is believed to provide a high PSRR, high accuracy, low power supply Current output Bandgap circuit. The Current output Bandgap circuit may also be configured to generate precise reference voltages, by passing its reference output current through specified resistors. Further modifications and alternate embodiments of various aspects of the invention will be apparent to those skilled in the art in view of this description. For example, though transistors were described herein as fabricated using MOS (Metal Oxide Semiconductor) technology, the transistors are not limited to such, and may be fabricated using any other appropriate technology. It is intended that the following claims be interpreted to embrace all such modifications and changes and, accordingly, the specification and drawings are to be regarded in an illustrative rather than a restrictive sense.

What is claimed is:

1. A circuit, comprising:

a current generation circuit coupled between a power supply node and a ground node and configured for generating a reference current; and a current replication circuit configured for transferring a copy of the reference current to an output node of the circuit, wherein the current replication circuit comprises:

a first cascode current source coupled between the power supply node and the output node;

a second cascode current source and a third cascode current source wherein voltages generated across the second and third cascode current sources are supplied to control inputs of the first cascode current source for transferring the copy of the reference current to the output node; and a first operational amplifier coupled between the current generation circuit and the second and third cascode current sources for ensuring that the copy of the reference current is accurately transferred to the output node.

2. The circuit as recited in claim 1, wherein the current generation circuit comprises:

a second operational amplifier; and a pair of single transistor current sources, each coupled to a different input of the second operational amplifier and sharing a mutually coupled gate connection, which is coupled to an output of the second operational amplifier.

3. The circuit as recited in claim 2, wherein the current generation circuit further comprises a pair of resistors, each coupled to a corresponding different input of the second operational amplifier and a different one of the pair of single transistor current sources, wherein a resistance value of one of the pair of resistors is larger than a resistance value of the other of the pair of resistors by an integer factor of M.

4. The circuit as recited in claim 2, wherein the pair of single transistor current sources comprises a pair of NMOS transistors, each coupled between a corresponding different input of the second operational amplifier and the ground node.

5. The circuit as recited in claim 4, wherein the second and third cascode current sources comprise a pair of NMOS cascode current sources.

6. The circuit as recited in claim 5, wherein a ratio between a width of the single transistor current sources and a width of lower transistors within the second and third cascode current sources is different than 1.0 when transferring a linearly scaled copy of the reference current, and equal to 1.0 when transferring a substantially identical copy of the reference current, to the second and third cascode current sources.

7. The circuit as recited in claim 5, wherein upper transistors within the second and third cascode current sources share a mutually coupled gate connection, and wherein lower transistors within the second and third cascode current sources share another mutually coupled gate connection.

8. The circuit as recited in claim 7, wherein the mutually coupled gate connection between the upper transistors within the second and third cascode current sources is coupled to an output of the first operational amplifier, and wherein the mutually coupled gate connection between the lower transistors within the second and third cascode current sources is coupled to the output of the second operational amplifier.

9. The circuit as recited in claim 8, wherein the current replication circuit further comprises a biasing circuit coupled between the power supply node and the second and third cascode current sources.

10. The circuit as recited in claim 9, wherein the biasing circuit comprises:

a diode-connected transistor coupled between the power supply node and the second cascode current sources; and a voltage generator coupled between the power supply node and the third cascode current sources.

11. The circuit as recited in claim 10, wherein the voltage generator comprises a first pair of serially-coupled PMOS transistors, one whose gate terminal is coupled to a drain terminal of the upper transistor within the second cascode current sources, and another whose gate terminal is coupled to a drain terminal of the upper transistor within the third cascode current sources.

12. The circuit as recited in claim 11, wherein the first cascode current source comprises a second pair of serially-coupled PMOS transistors, wherein upper transistors within the first cascode current source and the first pair of serially-coupled PMOS transistors share a mutually coupled gate connection, and wherein lower transistors within the first cascode current source and the first pair of serially-coupled PMOS transistors share another mutually coupled gate connection.

13. The circuit as recited in claim 12, further comprising a resistive element coupled between the output node of the circuit and the ground node and configured for converting the copy of the reference current into a reference voltage.

14. A circuit, comprising:

a current generation circuit coupled between a power supply node and a ground node and configured for generating a reference current, wherein the current generation circuit comprises:

a first operational amplifier coupled for controlling current flow through a pair of single transistor current sources, each coupled to a different input of the first operational amplifier and sharing a mutually coupled gate connection, which is coupled to an output of the first operational amplifier; and a current replication circuit configured for transferring a copy of the reference current to an output node of the circuit, wherein the current replication circuit comprises:

a first cascode current source coupled between the power supply node and the output node;

a second cascode current source coupled between the power supply node and the ground node; and a second operational amplifier having one input coupled to the current generation circuit, another input coupled to the second cascode current source, and an output coupled to the first and second cascode current sources for ensuring that the copy of the reference current is accurately transferred to the output node.

15. The circuit as recited in claim 14, wherein the current generation circuit further comprises a pair of resistors, each coupled to a corresponding different input of the first operational amplifier and a different one of the pair of single transistor current sources, wherein a resistance value of one of the pair of resistors is larger than a resistance value of the other of the pair of resistors by an integer factor of M.

16. The circuit as recited in claim 14, wherein the pair of single transistor current sources comprises a pair of PMOS transistors, each coupled between a corresponding different input of the first operational amplifier and the power supply node.

17. The circuit as recited in claim 14, wherein the second cascode current source is coupled in series with a diode-connected transistor between the power supply node and the ground node.

18. The circuit as recited in claim 14, wherein the second operational amplifier is coupled for controlling current flow through the first and second cascode current sources, each being coupled to the output of the second operational amplifier and the output of the first operational amplifier.

19. The circuit as recited in claim 18, wherein the first and second cascode current sources comprise a first pair and a second pair of serially-coupled PMOS transistors, respectively, wherein upper transistors within the first and second cascode current sources share a mutually coupled gate connection, and wherein lower transistors within the first and second cascode current sources share another mutually coupled gate connection.

20. The circuit as recited in claim 19, wherein a ratio between a width of one of the pair of single transistor current sources and a width of one transistor within the first and second cascode current sources is made different than 1.0 for transferring a linearly scaled copy of the reference current, and equal to 1.0 for transferring a substantially identical copy of the reference current, to the first and second cascode current sources.

21. The circuit as recited in claim 20, further comprising a resistive element coupled between the output node of the circuit and the ground node and configured for converting the copy of the reference current into a reference voltage.

22. A method for making a bandgap circuit configured for generating and replicating a reference current with high accuracy and low power supply noise sensitivity, wherein the method comprises:

fabricating a current generation circuit configured for generating the reference current, wherein said fabricating a current generation circuit comprises coupling a first operational amplifier for controlling current flow through a pair of single transistor current sources, each being coupled to a different input of the first operational amplifier and sharing a mutually coupled gate connection, which is coupled to an output of the first operational amplifier; and fabricating a current replication circuit configured for replicating the reference current with high accuracy and low power supply noise sensitivity at an output node of the bandgap circuit, wherein said fabricating a current replication circuit comprises coupling a second operational amplifier between the current generation circuit and a pair of cascode current sources, each being coupled to an output of the second operational amplifier and the output of the first operational amplifier.

23. The method as recited in claim 22, wherein said fabricating a current generation circuit further comprises coupling each of a pair of resistors to a corresponding different input of the first operational amplifier and a different one of the pair of single transistor current sources, and wherein a ratio of resistance values of the pair of resistors is an integer factor of M.

24. The method as recited in claim 22, wherein the pair of single transistor current sources comprises n-channel transistors if a lower power supply voltage is desired for running the bandgap circuit.

25. The method as recited in claim 22, wherein the pair of cascode current sources comprise a first pair and a second pair of serially-coupled transistors, wherein upper transistors within the pair of cascode current sources share a mutually coupled gate connection, and wherein lower transistors within the pair of cascode current sources share another mutually coupled gate connection.

26. The method as recited in claim 25, wherein the first and second pairs of serially-coupled transistors comprise p-channel transistors.

27. The method as recited in claim 25, wherein the first and second pairs of serially-coupled transistors comprise n-channel transistors.

28. The method as recited in claim 25, further comprising connecting the current replication circuit to the current generation circuit by coupling the mutually coupled gate connection of the upper transistors to the output of the first operational amplifier and coupling the mutually coupled gate connection of the lower transistors to the output of the second operational amplifier.

29. The method as recited in claim 25, further comprising connecting the current replication circuit to the current generation circuit by coupling the mutually coupled gate connection of the upper transistors to the output of the second operational amplifier and coupling the mutually coupled gate connection of the lower transistors to the output of the first operational amplifier.

* * * * *

UNITED STATES PATENT AND TRADEMARK OFFICE

CERTIFICATE OF CORRECTION

PATENT NO. : 7,199,646 B1
APPLICATION NO. : 10/940184
DATED : April 3, 2007
INVENTOR(S) : Zupcau et al.

It is certified that error appears in the above-identified patent and that said Letters Patent is hereby corrected as shown below:

IN THE CLAIMS:

Col. 21, line 59: delete “sources” and replace with --source--.

Col. 21, line 60: delete “sources” and replace with --source--.

Signed and Sealed this

Fourteenth Day of August, 2007

JON W. DUDAS
*Director of the United States Patent and Trademark Office*